US007306354B2

(12) United States Patent
Haas

(10) Patent No.: US 7,306,354 B2
(45) Date of Patent: Dec. 11, 2007

(54) LIGHT HOUSING AND SYSTEM FOR PROVIDING A GLITTERING LIGHT EFFECT

(76) Inventor: Ed Haas, 104 Oakridge Avenue, Innerkip, Ontario (CA) N0J 1M0

( * ) Notice: Subject to any disclaimer, the term of this patent is extended or adjusted under 35 U.S.C. 154(b) by 250 days.

(21) Appl. No.: 11/133,192

(22) Filed: May 20, 2005

(65) Prior Publication Data

US 2005/0259428 A1 Nov. 24, 2005

Related U.S. Application Data

(63) Continuation-in-part of application No. 10/722,445, filed on Nov. 28, 2003, now abandoned.

(51) Int. Cl.
*F21S 10/00* (2006.01)

(52) U.S. Cl. ..... 362/432; 362/147; 362/151; 362/152; 362/248; 362/249; 362/252; 362/362; 362/372; 362/368

(58) Field of Classification Search ..... None
See application file for complete search history.

(56) References Cited

U.S. PATENT DOCUMENTS 4,566,141 A 1/1986 Mahoney
4,600,975 A * 7/1986 Roberts ..... 362/147
4,729,074 A * 3/1988 Steadman ..... 362/148
5,752,760 A * 5/1998 Dealey et al. ..... 362/551
5,813,751 A * 9/1998 Shaffer ..... 362/249
5,816,687 A * 10/1998 Tapp ..... 362/250
5,851,304 A * 12/1998 Giraud et al. ..... 134/3
6,019,488 A * 2/2000 Hastings ..... 362/374
6,101,778 A * 8/2000 Mårtensson ..... 52/582.1
6,379,190 B1 * 4/2002 Prazoff ..... 439/654
6,447,141 B1 9/2002 Waldmann
6,572,239 B1 * 6/2003 Harbin ..... 362/145
6,592,237 B1 * 7/2003 Pledger ..... 362/147

FOREIGN PATENT DOCUMENTS

GB 2071837 A * 9/1981

* cited by examiner

*Primary Examiner*—Sandra O'Shea
*Assistant Examiner*—Danielle Dunn

(57) ABSTRACT

A housing for holding one or more light sources. The housing includes an elongate body defining a channel and one or more support elements for positioning the light source in the channel. The body includes an exposed portion having one or more light-transmitting parts through which light from light source is transmittable. The support element locates the light so that the light source is spaced apart from the light-transmitting part by a preselected distance.

10 Claims, 49 Drawing Sheets

LIGHT HOUSING AND SYSTEM FOR PROVIDING A GLITTERING LIGHT EFFECT

This is a continuation-in-part application of application Ser. No. 10/722,445, filed Nov. 28, 2003 now abandoned.

FIELD OF THE INVENTION

This invention relates to a housing for holding a light source.

BACKGROUND OF THE INVENTION

Many devices are known for attachment to a structure, such as an exterior of a house, in which electric lights can be positioned. For example, U.S. Pat. No. 5,813,751 (Shaffer) discloses a device including an elongate channel having top and bottom walls joined by a rear wall and a front wall depending from the top wall. The device also includes a flexible, rectangular screen cover. A string of Christmas lights is positionable in the channel, when the cover screen is removed.

The invention disclosed in Shaffer suffers from the defect that it is relatively inconvenient to position the Christmas lights in the device, because the positioning is effected by means of cord clamps. The device includes a main body which is fastened to a structure using fasteners, such as screws. However, the cord clamps also include screws which have to be tightened so that they will hold the Christmas lights. Also, the main body of the device includes two portions—a body defining a channel, as well as the screen cover—so that the user is required to handle two components on installation, as well as fasteners and the cord clamps, and the screws needed for the cord clamps. In addition, the Shaffer device is adapted to permit light to be transmitted through the screen cover only, and the lighting effects which can be produced using the Shaffer device are therefore somewhat limited.

There is therefore a need for a simple housing adapted for attachment to a structure adapted for holding a light source therein.

SUMMARY OF THE INVENTION

In a broad aspect of the present invention, there is provided a housing for holding one or more light sources. The housing includes an elongate body defining a channel and one or more support elements for positioning the light source in the channel. The body includes an exposed portion having one or more light-transmitting parts through which light from light source is transmittable. The support element locates the light source so that the light source is spaced apart from the light-transmitting part by a preselected distance.

In another aspect, the body includes a mounting portion for mounting the housing to a structure.

In another of its aspects, the support element is integrally formed in the mounting portion of the body.

In yet another aspect, the support element is movable between an initial position, in which the support element is substantially coplanar with the mounting portion, and an operational position, in which the support element extends from the mounting portion into the channel.

In another aspect, the body includes a first tab at a first end thereof and a second tab at a second end thereof, the first and second tabs being adapted to mate with respective tabs in other bodies positioned adjacent to the first and second ends respectively, for locating said other bodies substantially in alignment with the body.

In another aspect, the invention includes a housing and light assembly system including a light assembly with one or more light sources comprising a plurality of segments connected end-to-end. Each segment has a main element, a first connector, and a second connector, the main element extending between the first connector and the second connector. The connectors are positioned at the ends of each segment respectively. The system also includes a housing assembly including a plurality of bodies defining one or more channels, and a plurality of support elements for locating the light source in the channel. Each main element is positioned by the support elements in the channel spaced apart from the housing by a preselected distance.

In yet another aspect, the invention includes a housing and light assembly system including a light assemblyand a housing assembly. The light assembly includes one or more light sources. The light assembly includes a plurality of segments connected end-to-end, each said segment having a main element, a first connector, and a second connector. The main element extends between the first connector and the second connector. The first and second connectors are positioned at the respective ends of each segment. The housing assembly includes one or more bases adapted to be secured to a structure and one or more bodies attachable to the base. Each body defines one or more channels. The base includes a plurality of support elements for locating the light source in the channel when the body is attached to the base. The body includes an exposed portion having one or more light-transmitting parts through which light from the light source is transmittable. Each main element is positioned by the support elements in the channel spaced apart from the light-transmitting part by a preselected distance.

In yet another aspect, the invention includes a housing for holding one or more light sources in a predetermined position relative to a structure. The housing includes an elongate body with a mounting portion for mounting the housing to the structure and an exposed portion extending from the mounting portion to define a channel. The housing also has one or more support elements for positioning the light source in the channel. The exposed portion obstructs light from the light source to provide a backlighting effect relative to the exposed portion.

BRIEF DESCRIPTION OF THE DRAWINGS

The invention will be better understood with reference to the drawings, in which.

DETAILED DESCRIPTION OF THE PREFERRED EMBODIMENT(S)

Figure 1A:
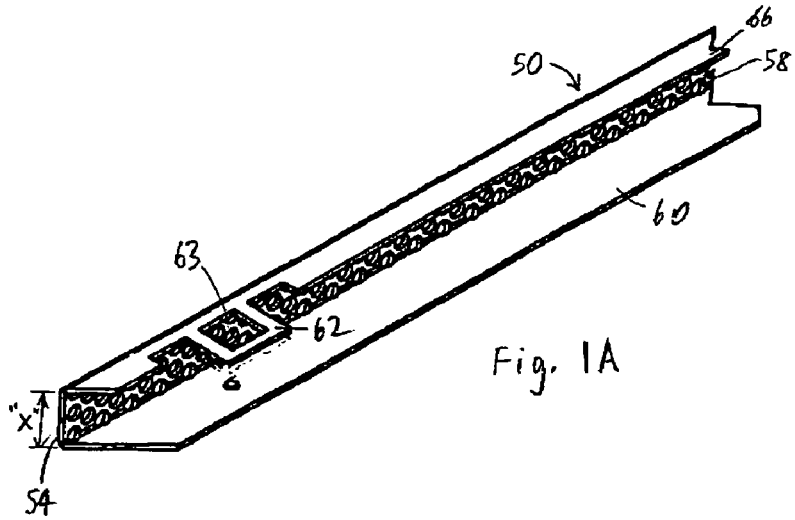
FIG. 1A is an isometric view of a preferred embodiment of a housing of the invention showing an interior side of a front wall, a first wall extending from the front wall, and a support element extending from the interior side of the front wall.
Figure 1C:
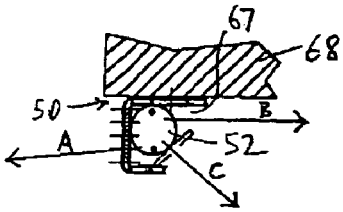
FIG. 1C is a cross-section of the housing of FIG. 1A attached to a structure and with a light source held therein, drawn at a smaller scale.

Reference is first made to FIGS. 1A-1F to describe a preferred embodiment of a housing indicated generally by the numeral 50 in accordance with the invention. As can be seen in FIG. 1C, the housing 50 is adapted for holding a light source 52 in the housing 50. The housing 50 has a front wall 54 with an exterior side 56 (FIG. 1B) and an opposed interior side 58 (FIG. 1A) and a first wall 60 extending from the front wall 54. Preferably, the first wall 60 extends from the interior side 58 of the front wall 54.

In the preferred embodiment, the housing 50 also includes a second wall 66 extending from the front wall 54 (FIG. 1A). Preferably, the second wall 66 is spaced apart from the first wall 60 a predetermined distance sufficient to permit the light source 52 to be received therebetween.

The second wall 66 includes a support element 62 for locating the light source 52 in the housing 50. As can be seen in FIGS. 1A and 1C, the support element 62 preferably is a tab movable between an open position (FIG. 1A), in which the light source 52 is receivable between the tab 62 and the first wall 60, and a closed position (FIG. 1C), in which the tab 62 holds the light source 52 in the housing 50. The tab 62 is shown in the open position in FIG. 1D and in the closed position in FIG. 1C. The tab 62 preferably includes an opening 63 (FIG. 1A), as will be described.

Figure 1B:
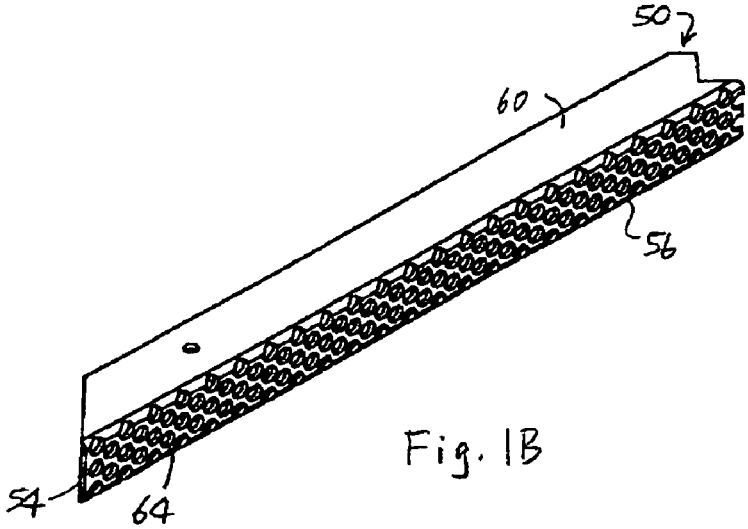
FIG. 1B is another isometric view of the housing of FIG. 1A showing the first wall and an exterior side of the front wall.

As can be seen in FIGS. 1A and 1B, the front wall 54 preferably includes a number of apertures 64. The apertures 64 are positioned so that, when the light source 52 is held in the housing 50, light from the light source 52 is transmittable through the apertures 64. Light transmitted through the apertures 64 is schematically represented in FIG. 1C by arrow "A".

For example, the first wall 60 and the second wall 66 are shown in FIGS. 1A and 1C as being spaced apart a distance "X" which is sufficient to permit the light source 52 (shown in FIG. 1C) to be received therebetween.

In the preferred embodiment, the first wall 60 is substantially planar. Preferably, the second wall 66 is also substantially planar. The second wall 66 can extend from the interior side 58 of the front wall 54 substantially parallel to the first wall 60 and spaced apart from the first wall 60 a predetermined distance sufficient to permit the light source 52 to be received therebetween. Preferably, the support element 62 is substantially coplanar with the second wall 66.

Figure 18A:
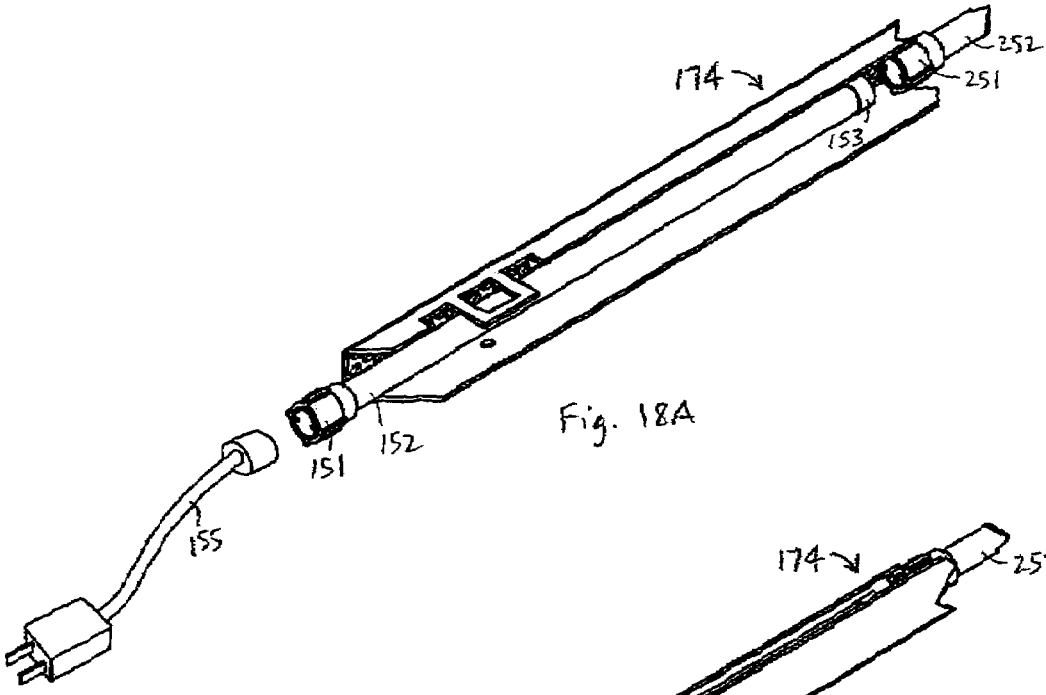
FIG. 18A is an isometric view of a housing and light assembly, drawn at a larger scale.

As can be seen in FIGS. 1C and 18A, when the light source 52 is held in the housing 50 by the support element 62, a gap 67 is defined between the second wall 66 and the first wall 60. Light, schematically represented by arrow "B" (FIG. 1C), is simultaneously transmitted from the light source 52 through the gap 67 and the apertures 64. The result is an aesthetically pleasing backlighting effect.

The opening 63 in the tab 62 also permits light from the light source 52 to be transmitted generally in substantially the same direction as light transmitted through the gap 67. Light from the light source 52 which is transmitted through the opening 63 is schematically represented in FIG. 1C by arrow "C". It will be appreciated that light is also transmitted from the light source 52 substantially parallel to arrow "C" along the length of the light source 52, except where blocked by the support element 62.

Figure 1D:
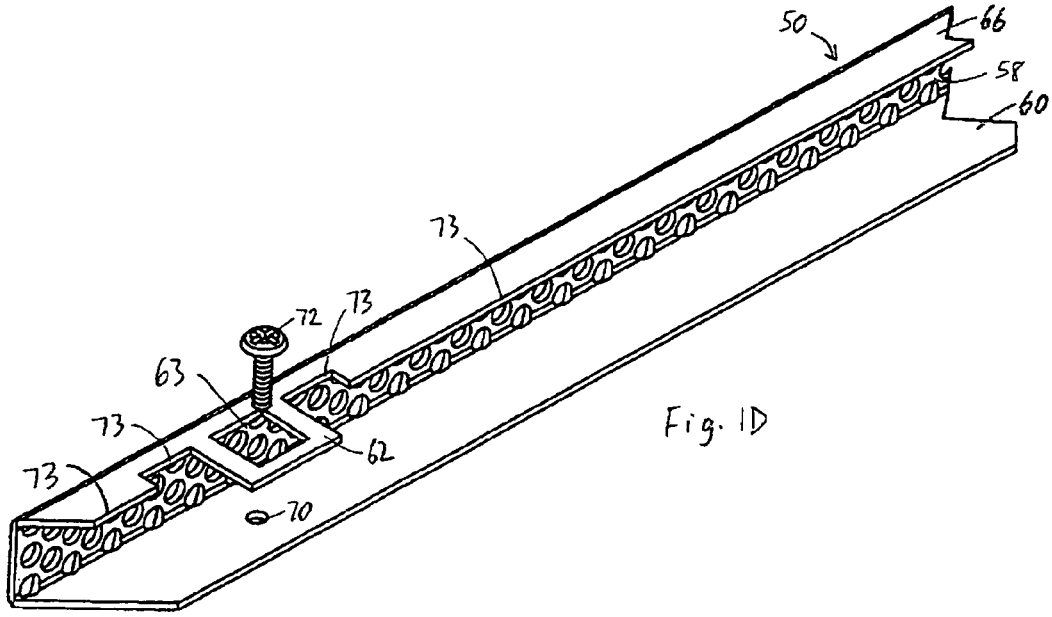
FIG. 1D is an isometric view of the housing of FIG. 1A with a fastener positioned to be passed through the support element and through a fastener hole in the first wall, drawn at a larger scale.
Figure 1E:
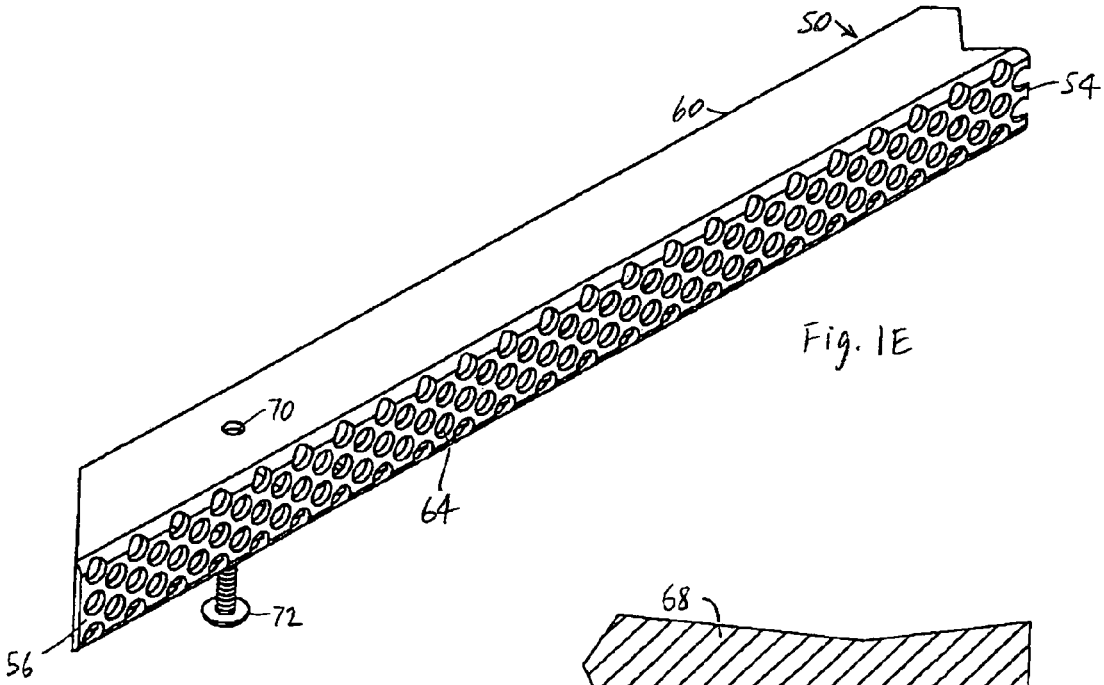
FIG. 1E is an isometric view of the housing and the fastener of FIG. 1D, showing an exterior side of the front wall and the first wall.
Figure 1F:
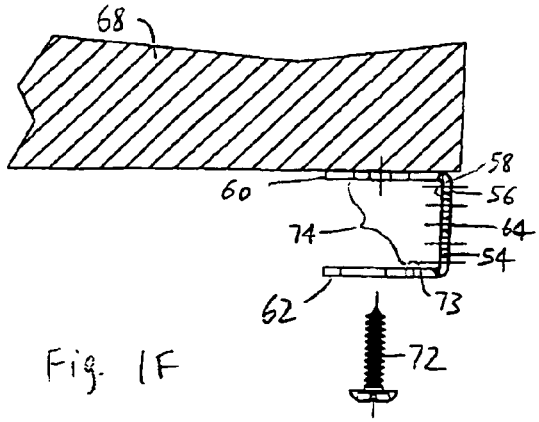
FIG. 1F is a cross-section of the housing of FIG. 1E showing the housing positioned adjacent to the structure, with the fastener positioned to be passed through the support element and through the fastener hole into the structure, drawn at a smaller scale.

For example, as can be seen in FIG. 1F, the second wall 66 includes a back edge 73 (FIG. 1D) which, together with the first wall 60, defines an opening 74. When the light source 52 is located in the housing 50 (i.e., as shown in FIG. 1C), light from the light source 52 is transmittable through the opening 74. The only obstructions to this transmission of light from the light source 52 through the opening 74 along the light source's length are the support elements 62.

In the preferred embodiment, the first wall 60 is adapted to be secured to a structure 68 (FIGS. 1C, 1F, 2, 3 and 4). Preferably, the first wall 60 includes a fastener hole 70 in which a fastener 72, such as a screw, is receivable. As shown in FIG. 1D, the tab 62 is preferably positioned so that the fastener 72 can be aligned with the fastener hole 70 through the opening 63 in the tab 62, thereby simplifying the installation of the housing 50 on the structure 68. An installer (not shown), who is typically positioned on a ladder when attaching the housing 50 to the structure 68, need only insert the fastener through the opening 63 and directly into the fastener hole 70 (FIGS. 1E, 1F). The fastener 72 in the fastener hole 70 is subsequently tightened until the fastener 72 secures the first wall 60 to the structure 68.

It will be understood that the various embodiments of the housings shown as being attached to the structure in the drawings are attached thereto by any suitable fasteners, and/or by any other suitable means. As many fastener holes 70 and fasteners 72 as are needed along a length of housing 50 are used. It will also be understood that, although only one support element is shown in a housing in the drawings, housings are typically formed to be elongate, and typically include a plurality of support elements. The support elements are typically spaced apart along a length of a housing at predetermined intervals sufficient to hold the light source securely in the housing.

The housing 50 is preferably included in a housing and light assembly 75 (FIGS. 2-4, 18A, and 18B) including the front wall 54, the first wall 60 and the tabs 62, as well as one or more light sources 52 held in the housing 50. The light source 52 is preferably held against the interior side 58 of the front wall 54 by support elements, or tabs, 62. Also, the light source 52 is preferably adapted for use with an external source of electric current, as will be described.

Figure 2:
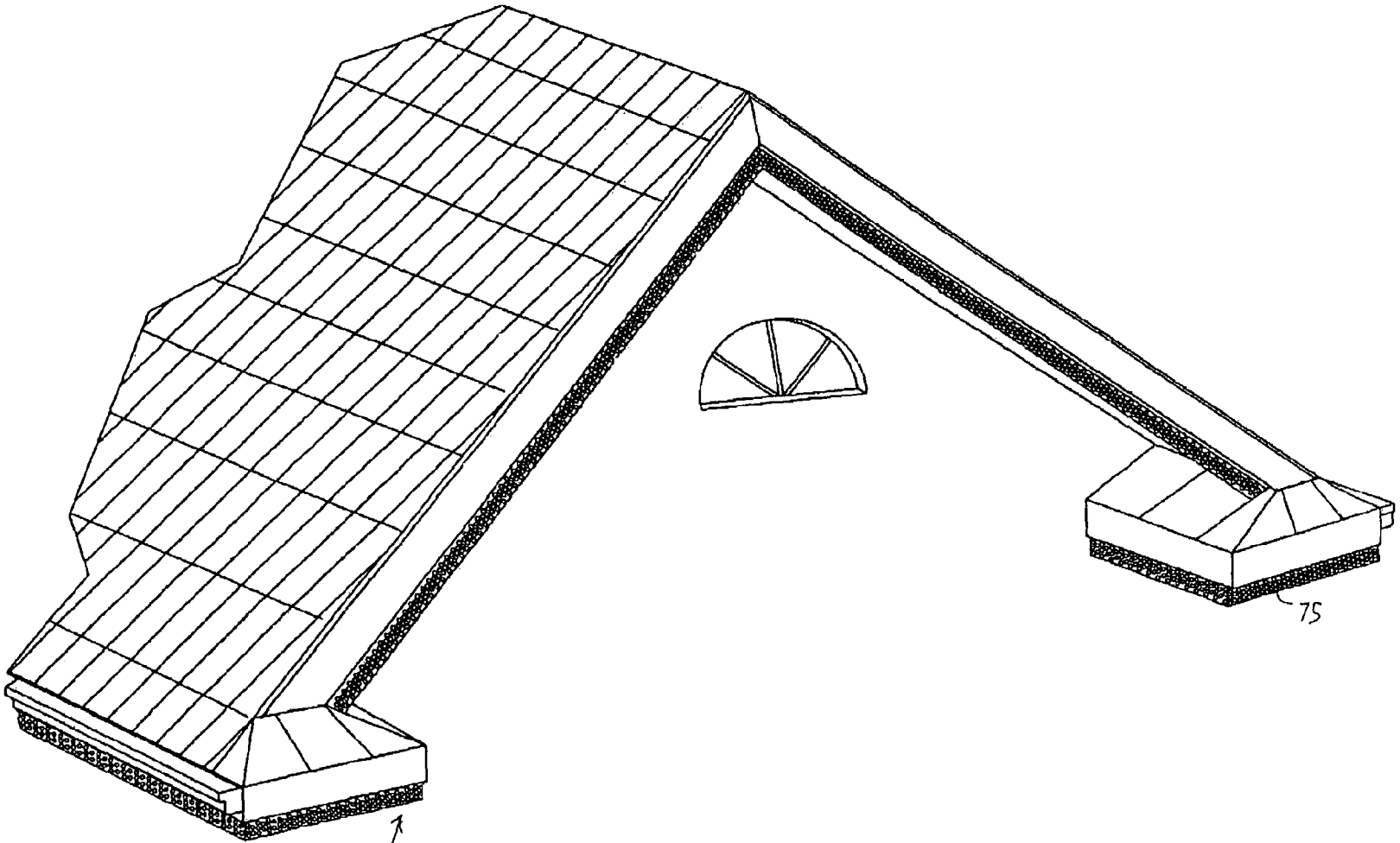
FIG. 2 is a isometric view of a structure to which a series of housing portions are attached to the structure in preselected locations drawn at a smaller scale.
Figure 3:
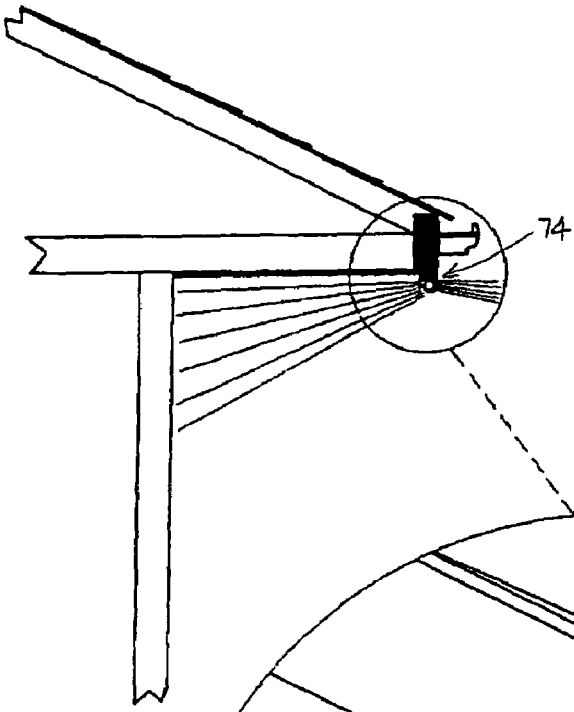
FIG. 3 is a side view of the housing of FIG. 1A, with a light source held therein and attached to the structure of FIG. 2 schematically showing light from the light source transmitted through openings in the housing, drawn at a larger scale.

Preferably, a number of housing and light assemblies 75, or housing portions, are positioned in series relative to each other, to form a decorative light system 80, as shown in FIG. 2. In the preferred embodiment, the ends of adjacent housing and light assemblies 75 are formed so that they cooperate to form a continuous, or substantially continuous, system positioned in a preselected location on the structure 68 (FIGS. 2, 4, 18A, 18B).

Preferably, the housing 50 comprises steel, aluminium, or a durable plastic material such as polyvinylchloride (PVC). The apertures 64 can have round shapes, or can have any other shape, or shapes, desired. The spacing of the apertures 64 in the front wall 54 can be regular, so that the apertures 64 form a pattern, or the spacing can be random. It will also be appreciated that the support element 62 could, alternatively, be of solid construction.

The light source 52 is preferably a rope light. As is known in the art, a rope light typically includes an elongate translucent tube (usually comprising a flexible plastic material) with one or more incandescent light elements disposed inside the tube. Rope lights for producing light in a variety of colors are available.

Figure 4:
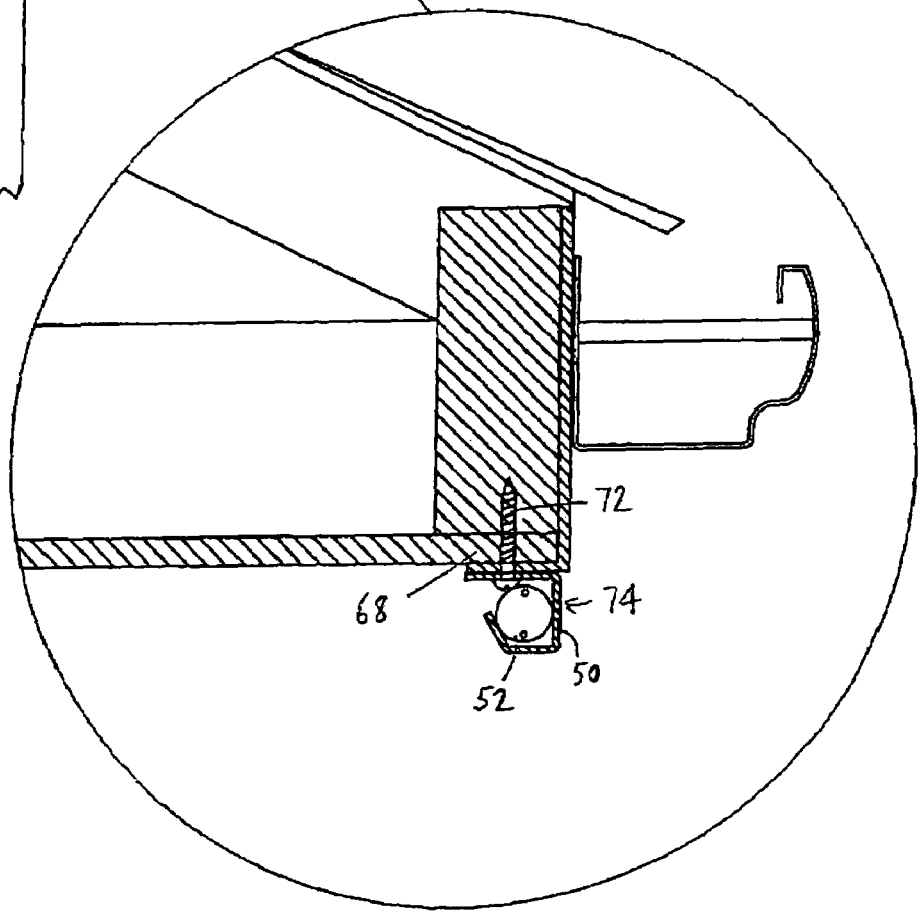
FIG. 4 is a side view of the housing and light assembly of FIG. 3 with the light source positioned therein, drawn at a larger scale.

In use, the housing 50 is positioned on the structure at a preselected location by the installer (not shown), and fasteners 72 are inserted through the fastener holes 70, to secure the housing 50 to the structure 68. The installer inserts the light source 52 into the housing 50, mounting the light source on the support element 62, which secures the light source 52 in the housing 50. Preferably, the support element 62 is deflected, or bent, to a closed position, to hold the light source 52 more securely in the housing 50. After the light source 52 is in place, another housing 50 is installed next to and adjacent to the first housing, and a light source 52 is also inserted and held therein. Each housing portion 50 with a light source held therein comprises a housing and light assembly 75. Once all the housing and light assemblies 75 required are in position on the structure (FIG. 2), electricity is provided to the light system 80 comprising the plurality of housing and light assemblies 75. As can be seen in FIGS. 1C and 4, the housing and light assemblies 75 provide both light transmitted through the apertures in the front walls and light transmitted through the opening 74 along the back of the housing (and through openings 63), to provide a backlighting effect. The overall effect of the light transmitted out of the housing both towards an observer (not shown) and away from the observer is aesthetically pleasing and unique.

Preferably, once attached, the housing 50 is allowed to remain in place on the structure 68, with the light source 52 therein. When the light source is not energized, the decorative light system 80 is unobtrusive. For example, if the system 80 is used primarily to provide a decorative lighting effect during the Christmas season, the system 80 can be left in place throughout the year, and the annual household task of putting up and taking down Christmas lights is thereby done away with.

Figure 5A:
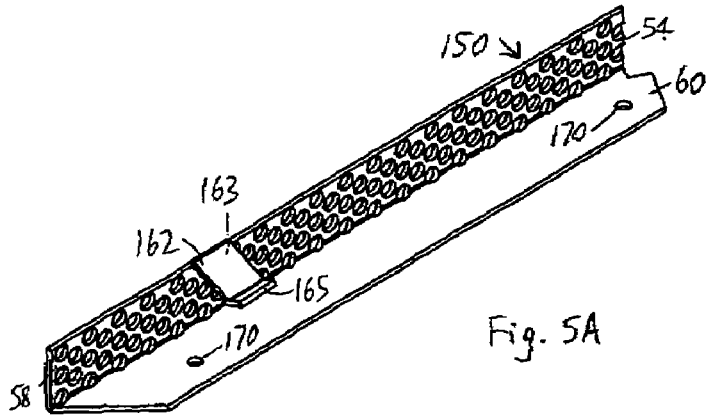
FIG. 5A is an isometric view of an alternative embodiment of the housing of the invention, drawn at a larger scale.
Figure 5C:
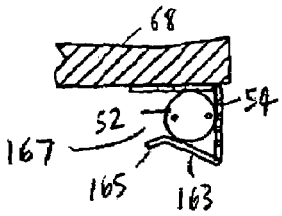
FIG. 5C is a cross-section of the housing of FIG. 5A attached to the structure and with the light source held therein, drawn at a smaller scale.
Figure 5B:
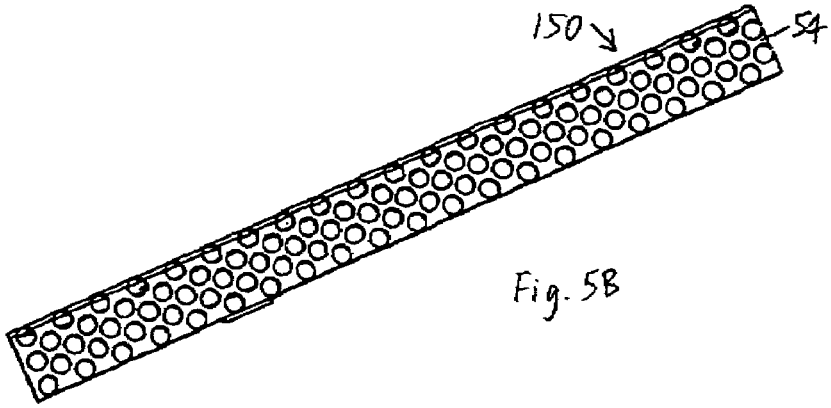
FIG. 5B is an elevation view of the front wall of the housing of FIG. 5A.

In an alternative embodiment shown in FIGS. 5A-5C, a housing 150 includes the front wall 54 and the first wall 60 and a support element 162 extending from the front wall 54. Preferably, the support element 162 extends from the interior side 58 of the front wall 54, and is movable between an open position (FIG. 5A) and a closed position (FIG. 5C). The light source 52 is receivable on the support element 162 (i.e., between the support element 162 and the first wall 60) when the support element 162 is in the open position. After the housing 150 has been attached to the structure 68 the light source 52 is positioned in the housing 150. Next, the support element 162 is bent to secure the light source 52 in the housing 150 so that the light source 52 is held in place between the support element 162, the interior side 58 of the front wall 54, and the first wall 60.

Preferably, the support element 162 is of solid construction (i.e., without an opening) and has a main portion 163 and a second portion 165. The second portion 165 is positioned at an angle relative to the main portion 163, and when the support element 162 is in a normal position (FIG. 5C), a gap 167 is defined between the second portion 165 and the first wall 60. The second portion 165 of the support element 162 is positioned at an angle to the first portion 163 to assist in guiding the light source 52 into the gap 167, when the light source 52 is to be inserted into the housing 150. The light source 52 is then pressed into the gap 167 by the installer, causing deflection of the support element 162 away from the first wall 60 (i.e., thereby widening the gap 167) sufficiently to enable the light source 52 to move through the gap 167 and into contact with the first portion 163. The support element 162 resiliently returns to its normal position after the light source 52 is located adjacent to the first portion 163, in which the gap 167 is insufficiently wide to permit the light source 52 through, so that the light source 52 is thereby held in the housing 150. It can be seen, therefore, that the support element 162 is not bent or deflected to a closed position in the same manner as the support element 62. This "snap-in" version of the support element is typically narrower than the bendable version of the support element, and may be used where the material comprising the housing is suitable. The snap-in version can provide somewhat quicker and easier installation, where the appropriate materials are used.

The support element 162 is located a preselected distance offset from the fastener hole 170 because the fastener (not shown) could not be passed through the solid support element 162. The support element 162 could, alternatively, have an opening therein (not shown). If the support element 162 had an opening therein, it could be located in alignment with a fastener hole. It will also be appreciated that the support element 62 (i.e., in housing 50) could, alternatively, be replaced by support element 162.

Figure 6A:
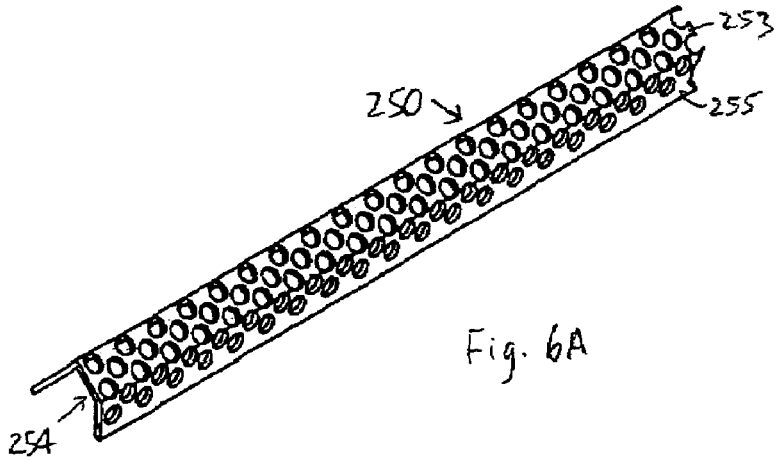
FIG. 6A is an isometric view of another alternative embodiment of the housing of the invention, showing an exterior side of a front wall with two substantially planar portions positioned at a predetermined angle relative to each other, drawn at a larger scale.
Figure 6C:
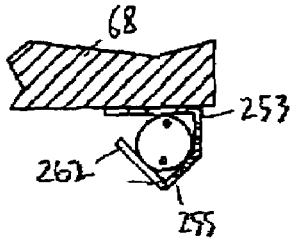
FIG. 6C is a cross-section of the housing of FIG. 6A attached to the structure and with the light source held therein, drawn at a small scale.
Figure 6B:
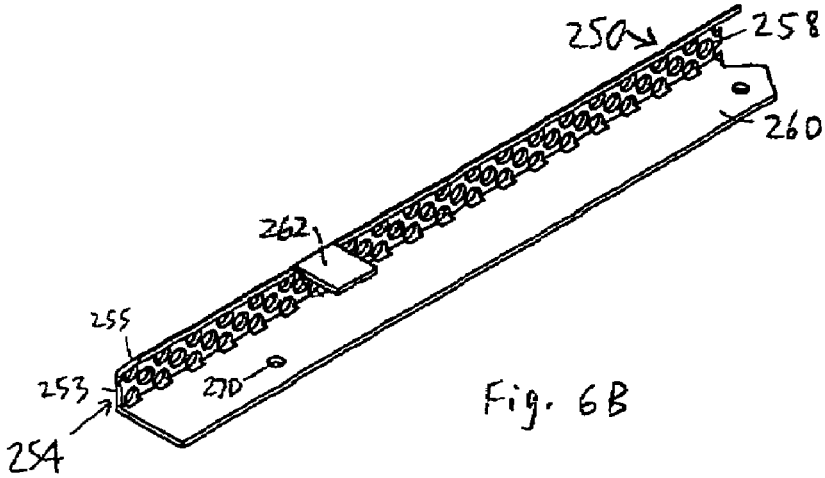
FIG. 6B is another isometric view of the housing of FIG. 6A.

In another alternative embodiment shown in FIGS. 6A-6C, a housing 250 includes a front wall 254 and a first wall 260 extending from the front wall 254. The front wall 254 includes a first portion 253, from which the first wall 260 extends, and a second portion 255. As can be seen in FIGS. 6A and 6C, the second portion 255 and the first portion 253 are both substantially planar, but they are positioned at an angle relative to each other. As can be seen in FIG. 6C, relatively more light can be directed downwardly and forwardly out of the housing 250 due to the positioning of the second portion 255 relative to the first portion 253, and the positioning of both relative to the light source 52 (FIG. 6C). The support element 262 is movable between an open position (FIG. 6B) and a closed position (FIG. 6C). Preferably, the support element 262 is solid, and is offset from the fastener hole 270. However, the support element 262 could, alternatively, include an opening therein (not shown).

Figure 7A:
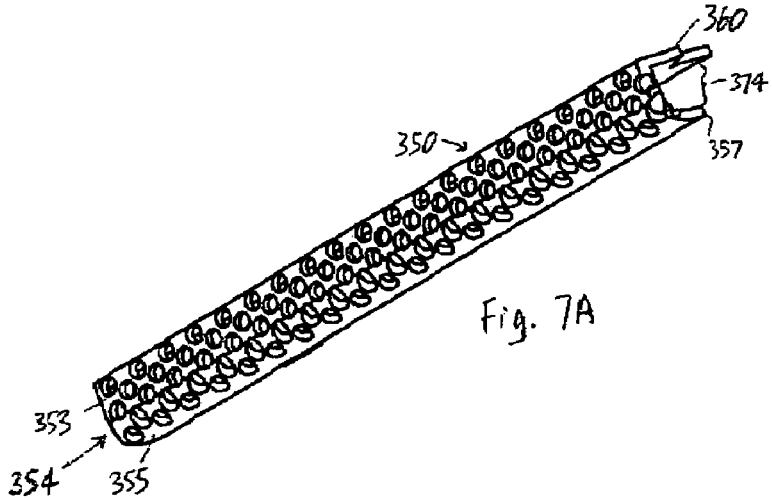
FIG. 7A is an isometric view of another alternative embodiment of the housing of the invention, drawn at a larger scale.
Figure 7C:
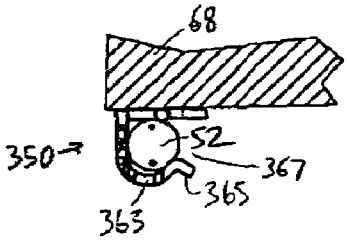
FIG. 7C is a cross-section of the housing of FIG. 7A attached to the structure and with the light source held therein, drawn at a smaller scale.
Figure 7B:
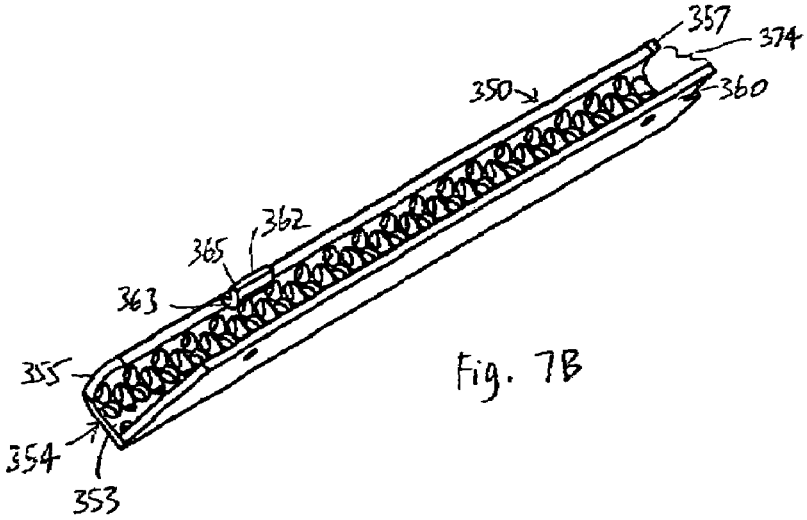
FIG. 7B is another isometric view of the housing of FIG. 7A.

In another alternative embodiment shown in FIGS. 7A-7C, a housing 350 includes a front wall 354 which includes a substantially planar first portion 353 and a curved second portion 355 extending from the first portion 353. A first wall 360 also extends from the first portion 353, and the second portion 355 of the front wall 354 includes a distal end 357 which is spaced apart from the first wall 360 a distance sufficient to permit the light source 52 to be received between the distal end 357 and the first wall 360.

Preferably, the housing 350 includes a support element 362 of solid construction, for locating and retaining the light source 52 in the housing 350. As can be seen in FIGS. 7B and 7C, the support element 362 preferably includes a first portion 363 and a second portion 365 positioned at an angle relative to the first portion 363.

The support element 362, like the support element 162, is a "snap-in" support element. The second portion 363 is positioned to guide the light source 52 towards a gap 367 (between the support element 362 and the first wall 360), when the light source 52 is being inserted into the housing 350. As the light source 52 is pressed into the gap 367, the support element 362 deflects away from the first wall 360, causing the gap 367 to widen, thereby allowing the light source 52 through. The light source 52 is held in place by the support element 362 because, after deflection, the support element 362 resiliently returns to its normal position (FIG. 7C), in which the gap 367 is insufficiently wide to permit the light source 52 to pass therethrough. The light source 52 is thereby held in the housing 350.

As can be seen in FIG. 7C, the second portion 355 of the housing 350 provides support for the light source 52 along the length of the light source 52. Because of this, the support elements 362 can be relatively narrow, thereby making installation of the light source 52 somewhat easier. Also, the apertures 64 in the second portion 355 provide an aesthetically pleasing effect, in which light from the light source is directed through the apertures downwardly (through portion 355) and horizontally (through portion 353), as well as through the gap 367 and an opening 374 along the back of the housing 350, to provide a backlighting effect.

Figure 8A:
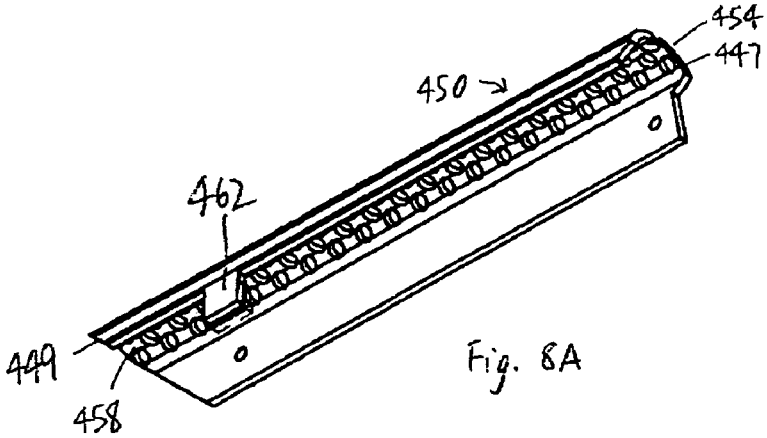
FIG. 8A is an isometric view of another alternative embodiment of the housing of the invention, drawn at a larger scale.
Figure 8C:
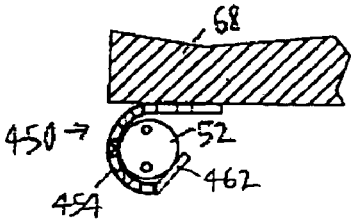
FIG. 8C is a cross-section of the housing of FIG. 8A attached to the structure and with the light source held therein, drawn at a smaller scale.
Figure 8B:
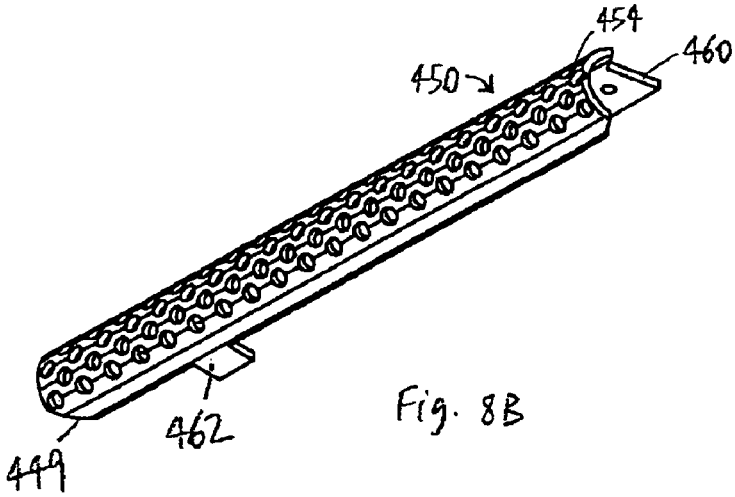
FIG. 8B is another isometric view of the housing of FIG. 8A.

In another alternative embodiment shown in FIGS. 8A-8C, a housing 450 includes a curved front wall 454 with a first end 447, from which a first wall 460 extends, and a second end 449, from which a support element 462 extends. As can be seen in FIG. 8C, the front wall 454 is preferably curved so that the light source 52 fits within an interior side 458 of the front wall 454.

Figure 9A:
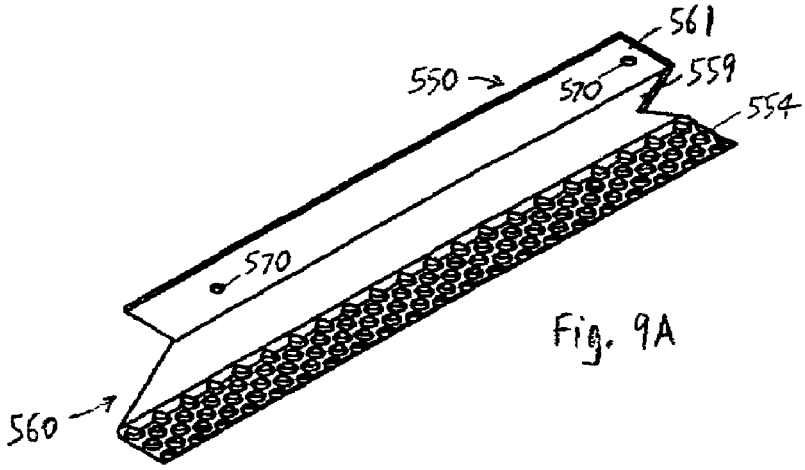
FIG. 9A is an isometric view of another alternative embodiment of the housing of the invention, drawn at a larger scale.
Figure 9C:
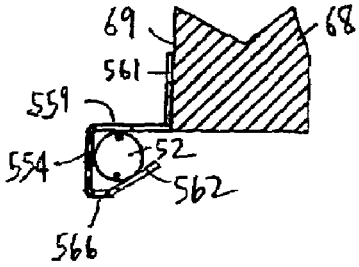
FIG. 9C is a cross-section of the housing of FIG. 9A attached to the structure and with the light source held therein, drawn at a smaller scale.
Figure 9B:
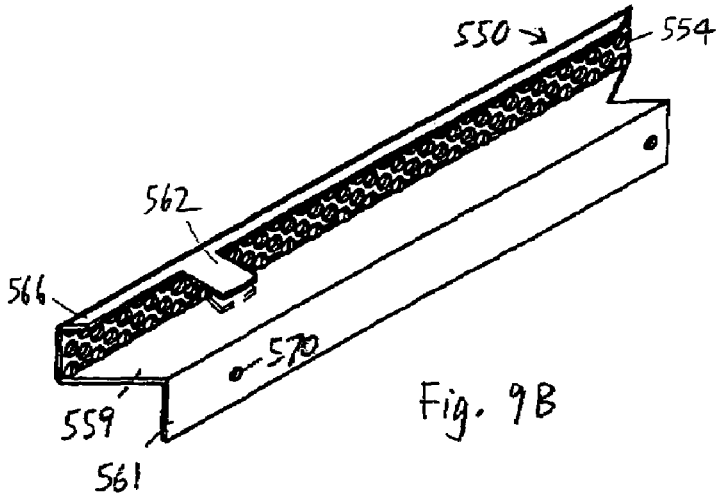
FIG. 9B is another isometric view of the housing of FIG. 9A.

In another alternative embodiment shown on FIGS. 9A-9C, a housing 550 includes a front wall 554, a first wall 560 extending from the front wall 554, and a second wall 566 also extending from the front wall 554. The first wall includes a first portion 559 which is adjacent to the front wall, and a second portion 561 which preferably is positioned substantially orthogonally to the first portion 559. The second portion 561 preferably includes fastener holes 570. As can be seen in FIG. 9C, the position of the second portion 561 relative to the first portion 559 can permit the front wall 554 to be positioned at a distance from a front surface 69 of the structure 68.

As can be seen in FIGS. 9C and 9D, the housing 550 preferably also includes a support element 562 which is movable between an open position and a closed position. When the support element 562 is in the open position, the second wall 566 and the support element 562 are spaced apart from the first portion 559 of the first wall 560 a distance sufficient to permit the light source 52 to be positioned between the first portion 559, on the one hand, and the second wall 566 and the support element 562, on the other hand. After the light source 52 is positioned in the housing 550, the support element 562 is bent to engage the light source 52 and press the light source 52 against the interior side 558 of the front wall 554 and also against the first portion 559.

Figure 10A:
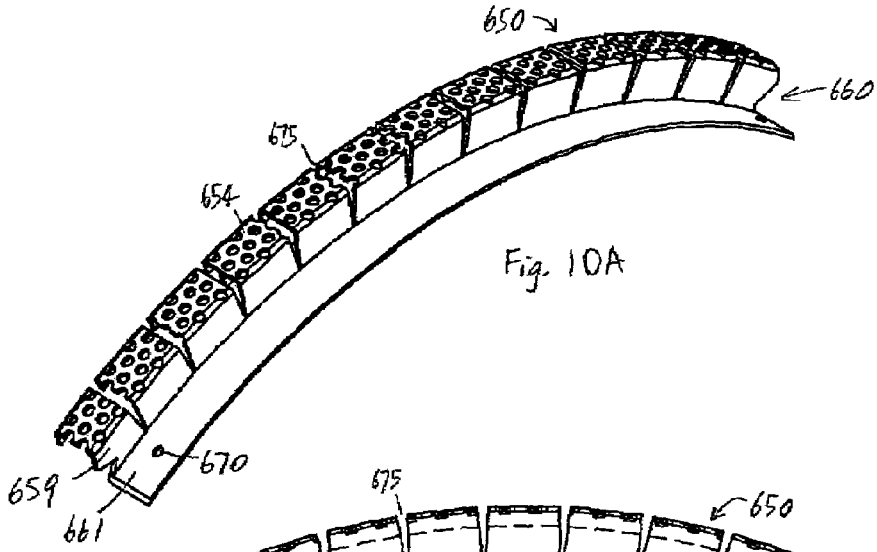
FIG. 10A is an isometric view of yet another alternative embodiment of the housing of the invention, curved to conform to a curvilinear structure, drawn at a larger scale.
Figure 10B:
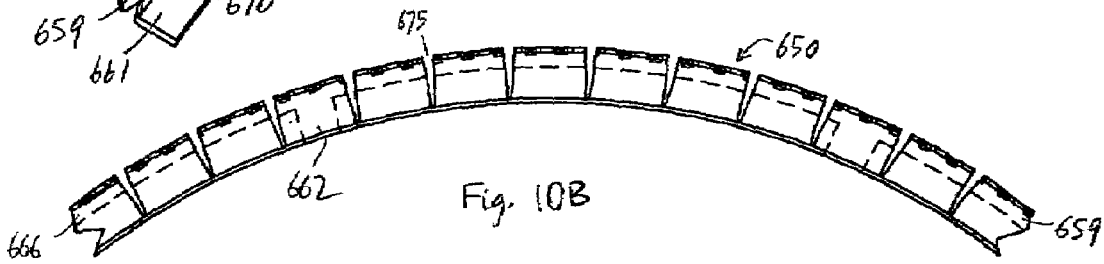
FIG. 10B is a top elevation view of the housing of FIG. 10A.
Figure 10C:
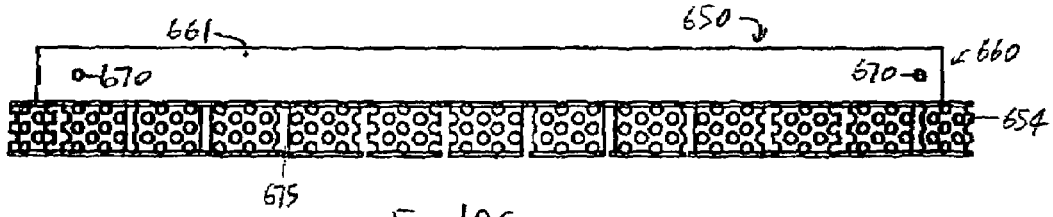
FIG. 10C is a front elevation view of the housing of FIG. 10A.

In another alternative embodiment shown in FIGS. 10A-10D, a housing 650 includes a front wall 654 and a first wall 660 extending from the front wall. The housing 650 also includes a second wall 666 (FIG. 10B) extending from the front wall 654, and a support element 662 extending from the second wall 666. The first wall 660 includes a first portion 659 and a second portion 661. The second portion 661 preferably includes fastener holes 670. As can be seen in FIGS. 10A-10C, the first portion 659 extends from the front wall 654, positioned substantially orthogonally to the front wall 654, and the second portion 661 extends substantially orthogonally to the first portion 659. The front wall 654 and the first portion 659 are divided by a series of cuts 675 which permit the housing 650 to be bent to conform with a curvilinear shape. Preferably, the cuts 675 are spaced apart a predetermined distance.

Figure 10D:
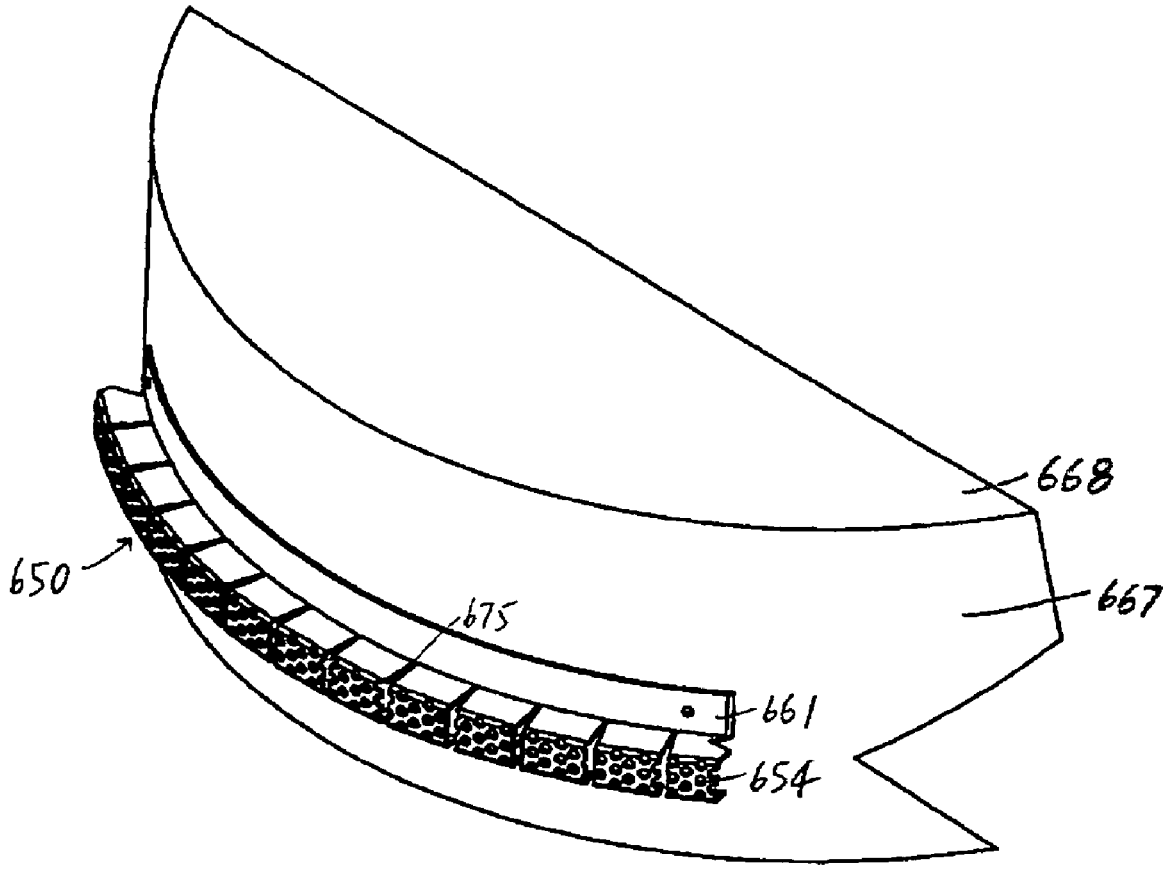
FIG. 10D is another isometric view of the housing of FIG. 10A, mounted on a curved surface of a structure, drawn at a smaller scale.

As can be seen in FIG. 10D, the housing 650 is bendable to conform to a curved surface 667 of a structure 668. Preferably, after the housing 650 has been bent to the appropriate curve, the housing 650 is attached to the curved surface 667 by fasteners (not shown) inserted through the fastener holes 670 and into the curved surface 667. Subsequently, the light source 52 is positioned in the housing 650, and then the support elements 662 are bent over the light source 52, to hold the light source 52 in the housing 650.

Figure 17A:
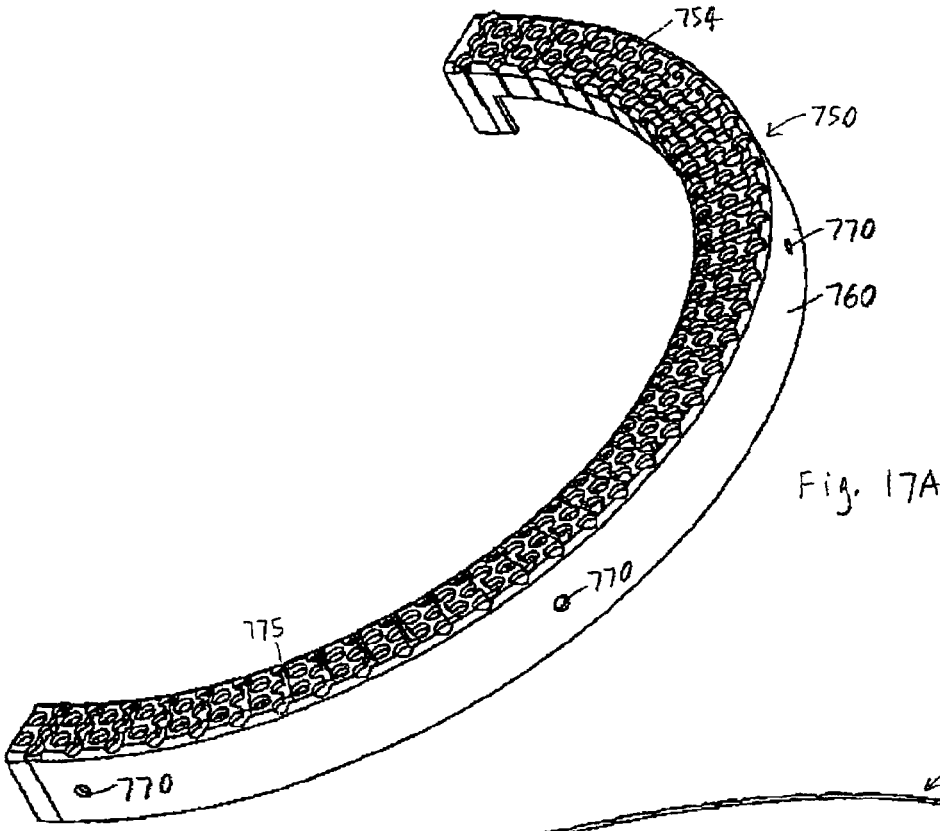
FIG. 17A is an isometric view of another alternative embodiment of the housing of the invention, curved to conform to a curved surface formed by an arch structure, drawn at a larger scale.
Figure 17B:
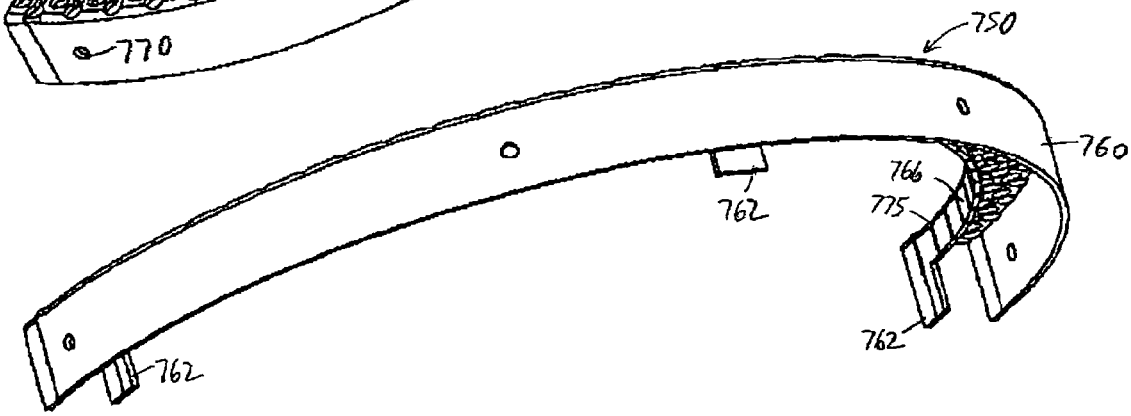
FIG. 17B is another isometric view of the housing of FIG. 17A.
Figure 17C:
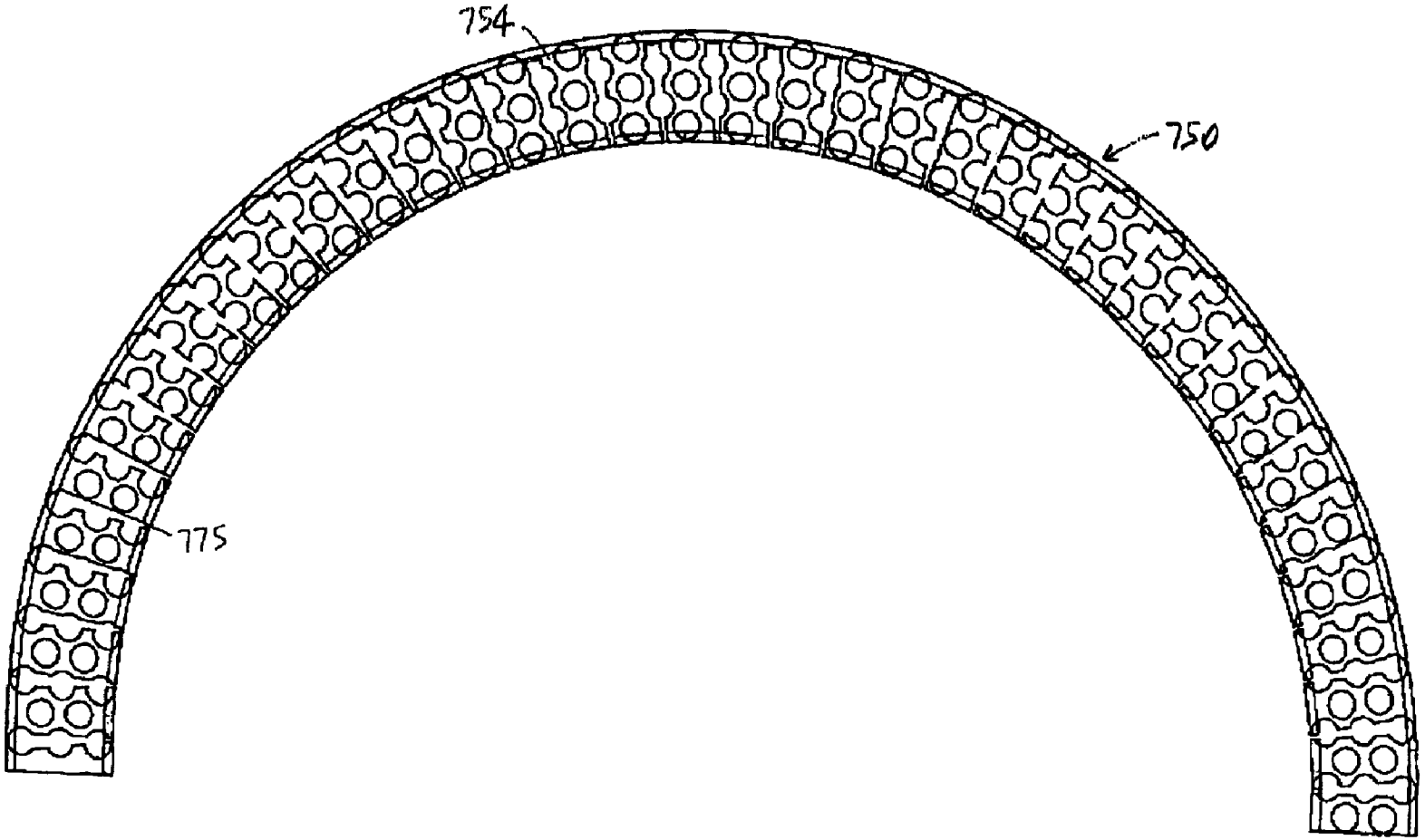
FIG. 17C is an elevation view of a front wall of the housing of FIG. 17A.
Figure 17D:
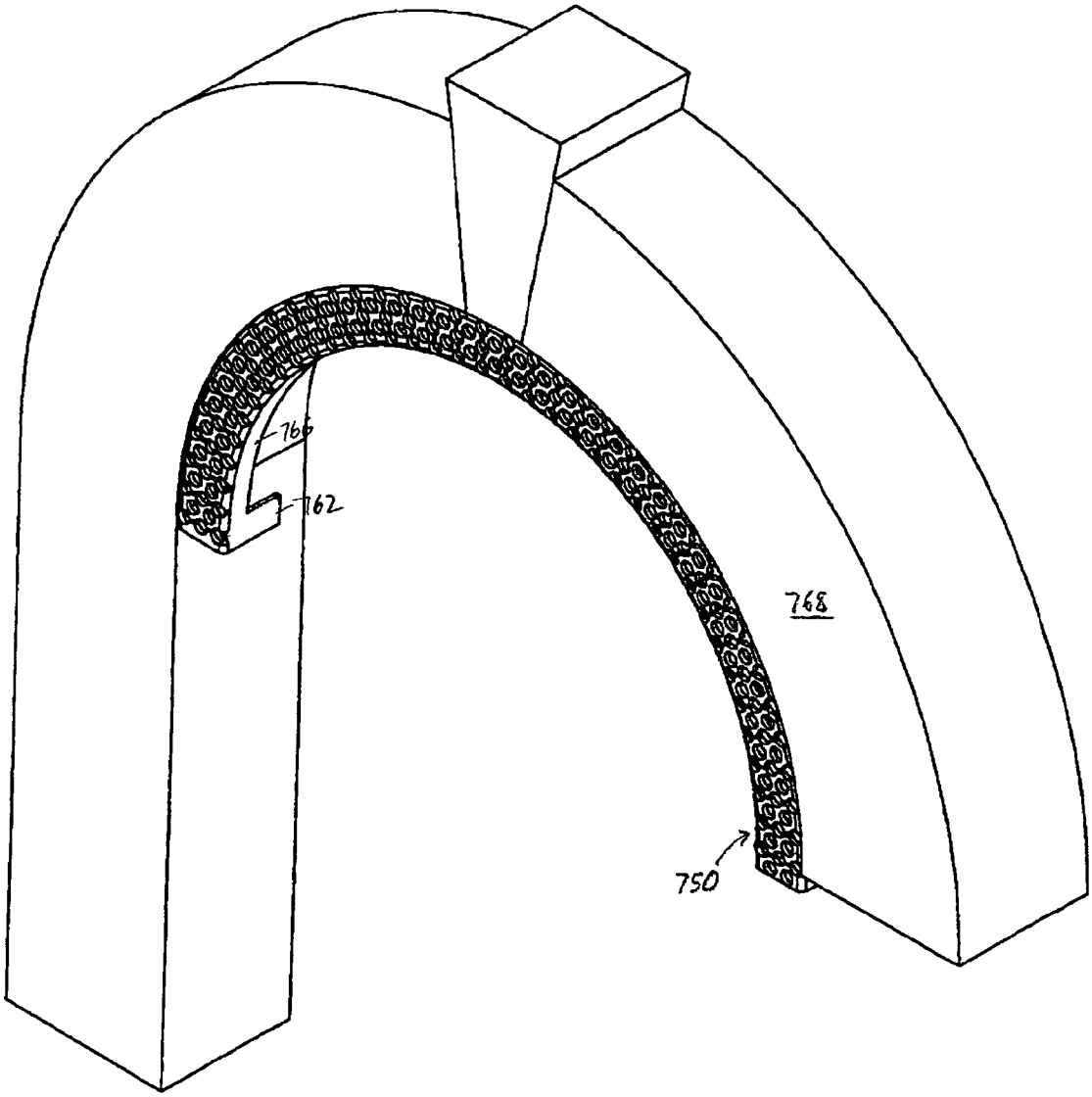
FIG. 17D is an isometric view of the housing of FIG. 17A attached to an arch structure, drawn at a smaller scale.

In another alternative embodiment shown in FIGS. 17A-17D, a housing 750 includes a front wall 754 and a first wall 760 extending from the front wall. The housing 750 also includes a second wall 766, also extending from the front wall 754, the second wall 766 being substantially parallel to the first wall 754. As can be seen in FIGS. 17A-17C, the front wall 754 and the second wall 766 are divided by a series of cuts 775 which permit the housing 750 to be bent to conform with a curvilinear shape. Support elements 762 extend from the second wall 766. Preferably, the cuts 775 are spaced apart a predetermined distance.

As can be seen in FIG. 17B, the housing 750 is bendable to conform to a curved surface formed by an arch structure 768. Preferably, after the housing 750 has been bent to the appropriate curve to conform with the curvature of the arch 768, the housing 750 is attached to the arch 768 by fasteners (not shown) inserted through the fastener holes 770 and into the arch structure 768. Subsequently, the light source 52 is positioned in the housing 750. The support elements 762 are then bent over the light source 52, to hold the light source 52 in the housing 750.

Figure 11A:
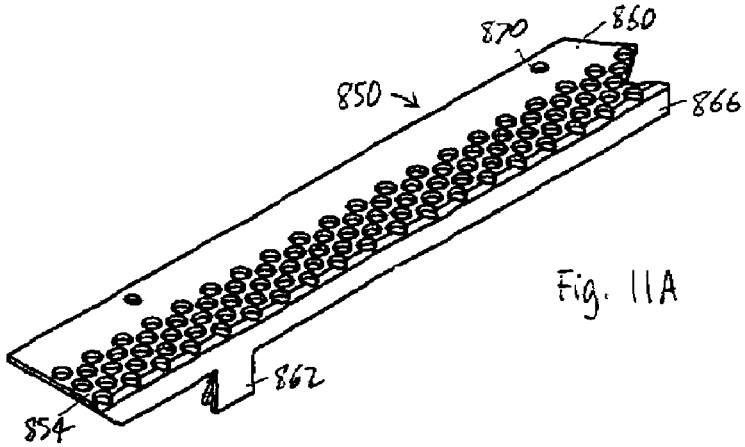
FIG. 11A is an isometric view of another alternative embodiment of the housing of the invention, drawn at a larger scale.
Figure 11C:
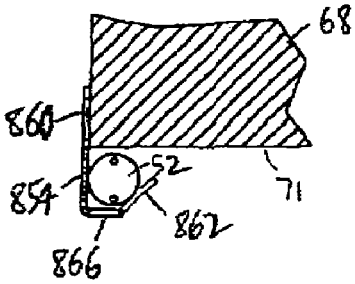
FIG. 11C is a cross-section of the housing of FIG. 11A attached to the structure and with the light source held therein, drawn at a smaller scale.
Figure 11B:
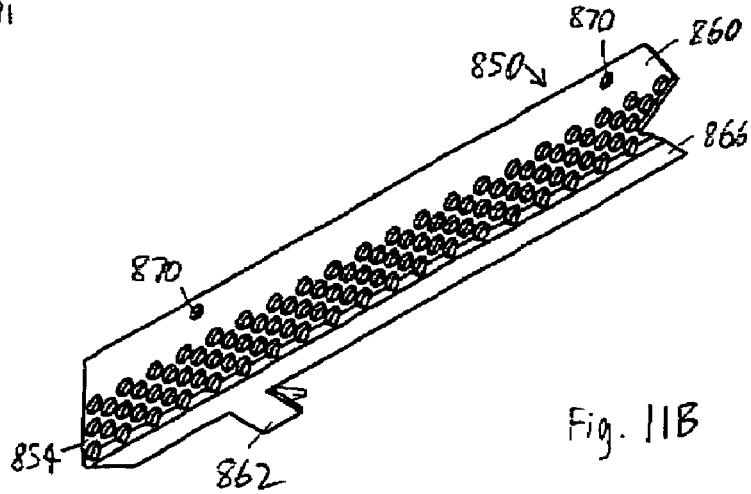
FIG. 11B is another isometric view of the housing of FIG. 11A.

In another alternative embodiment shown in FIGS. 11A-11C, a housing 850 includes a substantially planar front wall 854, a substantially planar first wall 860 extending from the front wall 854, the first wall 860 and the front wall 854 being substantially co-planar. The housing 850 additionally includes a second wall 866 extending substantially orthogonally from the front wall 854 and a support element 862 extending from the second wall. Fastener holes 870 are preferably included in the first wall 860 (FIGS. 11A, 11B).

As can be seen in FIG. 11C, after the housing is attached to the structure 68, the light source 52 is positioned between the second wall 866 and a second surface 71 of the structure 68. The support element 862 is then bent from the open position to the closed position (FIG. 11C, so that the support element 862 urges the light source 52 into contact with each of the front wall 854, the second wall 866, and the second surface 71 of the structure 68.

Figure 12A:
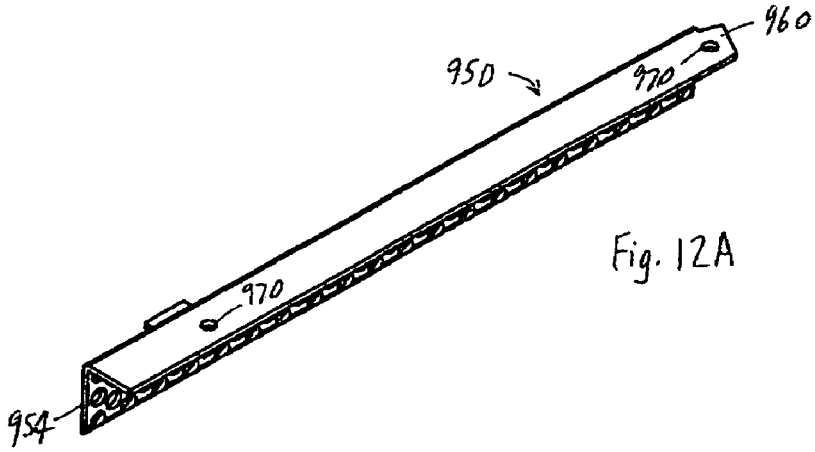
FIG. 12A is an isometric view of another alternative embodiment of the housing of the invention, drawn at a larger scale.
Figure 12C:
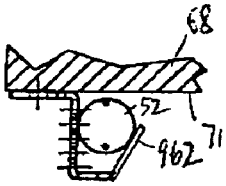
FIG. 12C is a cross-section of the housing of FIG. 12A attached to the structure and with the light source held therein, drawn at a smaller scale.
Figure 12B:
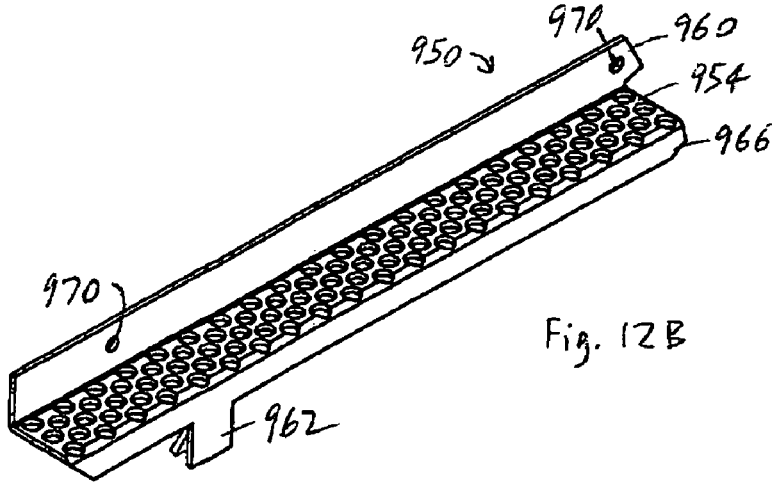
FIG. 12B is another isometric view of the housing of FIG. 12A.

In another alternative embodiment shown in FIGS. 12A-12C, a housing 950 includes a substantially planar front wall 954, and a substantially planar first wall extending from the first wall 960 extending from the front wall 954 in a first direction, as shown in FIGS. 12A and 12B. The first wall 960 includes fastener holes 970 therein. The housing 950 also includes a substantially planar second wall 966 extending from the front wall 954 in a second direction which is opposite to the first direction. Additionally, the housing 950 includes a support element 962 extending in the second direction and movable between an open position and a closed position.

As can be seen in FIG. 12C, the housing is mounted to the second surface 71 of the structure 68. The light source is positioned in the housing, i.e., between the second wall 966 and the second surface 71. The support element 962 is bent to the closed position in which the support element 962 urges the light source 52 against the front wall 954. In this embodiment, the light source 52 may also come into contact with the second surface 71 of the structure 68 (not shown).

Figure 13A:
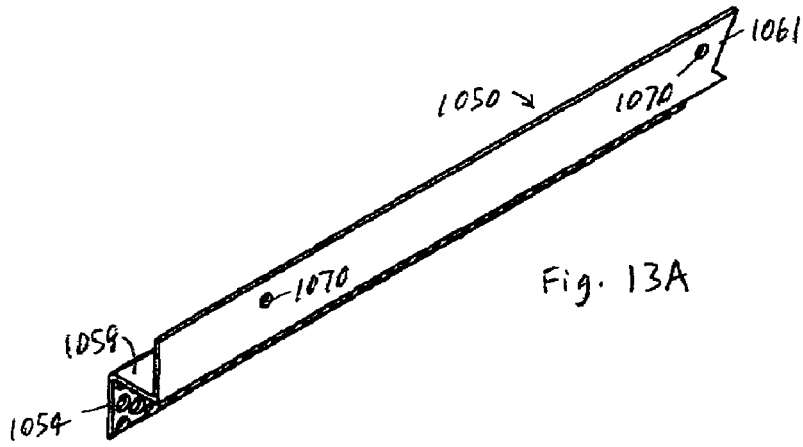
FIG. 13A is an isometric view of another alternative embodiment of the housing of the invention, drawn at a larger scale.
Figure 13C:
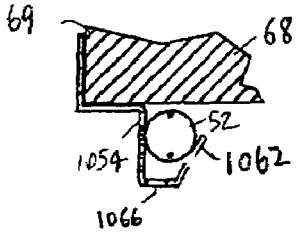
FIG. 13C is a cross-section of the housing FIG. 13A attached to the structure and with the light source held therein, drawn at a smaller scale.
Figure 13B:
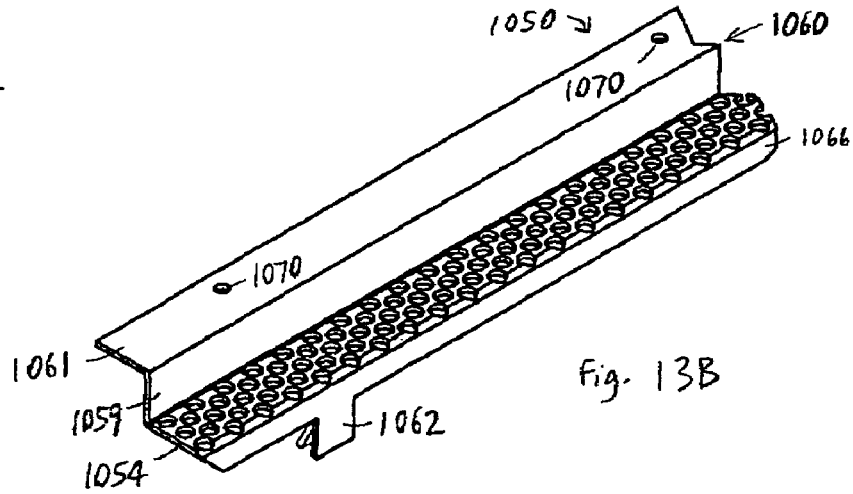
FIG. 13B is another isometric view of the housing of FIG. 13A.

In another alternative embodiment shown in FIGS. 13A-13C, a housing 1050 includes a substantially planar front wall 1054, a first wall 1060 having a substantially planar first portion 1059 extending in a first direction from the front wall 1054 and positioned substantially orthogonally to the front wall 1054, and including a second portion 1061. Preferably, the second portion 1061 is substantially planar and extends from the first portion 1059 in a direction away from the front wall 1054. The second portion 1061 includes fastener holes 1070. The housing 1050 also preferably includes a second wall 1066 extending substantially orthogonally from the front wall 1054 in a second direction which is substantially opposite to the first direction. Finally, the housing 1050 additionally includes a support element 1062 extending from the second wall 1066 in the second direction.

As can be seen in FIG. 13C, the second portion 1060 preferably is fastened to the front surface 69 of the structure 68. Because of the positioning of the second portion 1060 and the first portion 1059 relative to each other and relative to the front wall 1054, the light source 52, when held in the housing 1050, is offset back from the front surface 69. The support element 1062 is bent so that it urges the light source 52 against the front wall 1054, to hold the light source 52 in the housing 1050.

Figure 14A:
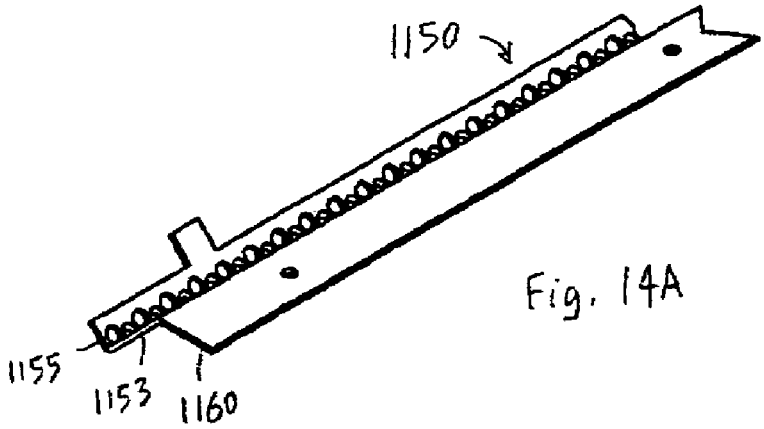
FIG. 14A is an isometric view of another alternative embodiment of the housing of the invention, drawn at a larger scale.
Figure 14C:
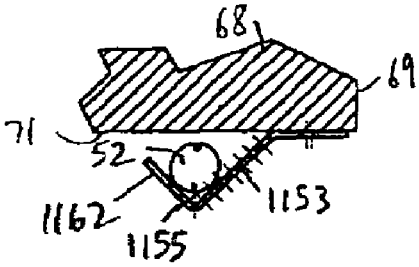
FIG. 14C is a cross section of the housing of FIG. 14A attached to the structure and with the light source held therein, drawn at a smaller scale.
Figure 14B:
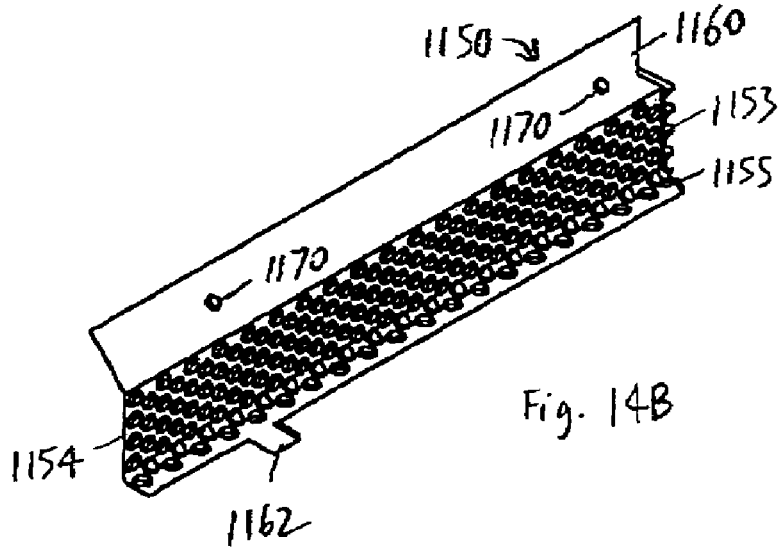
FIG. 14B is another isometric view of the housing of FIG. 14A.

In another alternative embodiment shown in FIGS. 14A-14C, a housing 1150 includes a front wall 1154 including a substantially planar first portion 1153 and a curved second portion 1155. Preferably, the housing 1150 includes a first wall extending from the first portion in a first direction away from the second portion. Additionally, the housing 1150 preferably includes one or more support elements 1162 extending from the curved second portion 1155 of the front wall 1154. As can be seen in FIG. 14C, the first wall 1160 is attached to the second surface 71 of the structure 68. The light source 52 is preferably positioned in the housing, held between the first portion 1153 and the second portion 1155 of the front wall 1154.

Figure 15A:
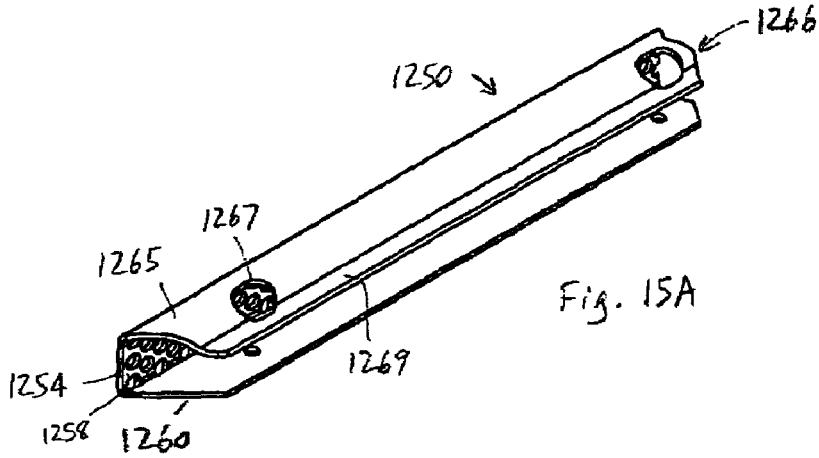
FIG. 15A is an isometric view of another alternative embodiment of the housing of the invention, drawn at a larger scale.
Figure 15C:
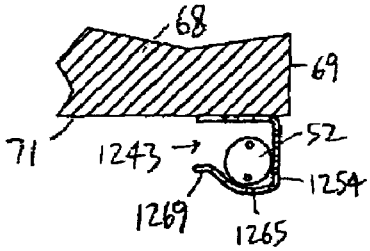
FIG. 15C is a cross-section of the housing of FIG. 15A attached to the structure and with the light source held therein, drawn at a smaller scale.
Figure 15B:
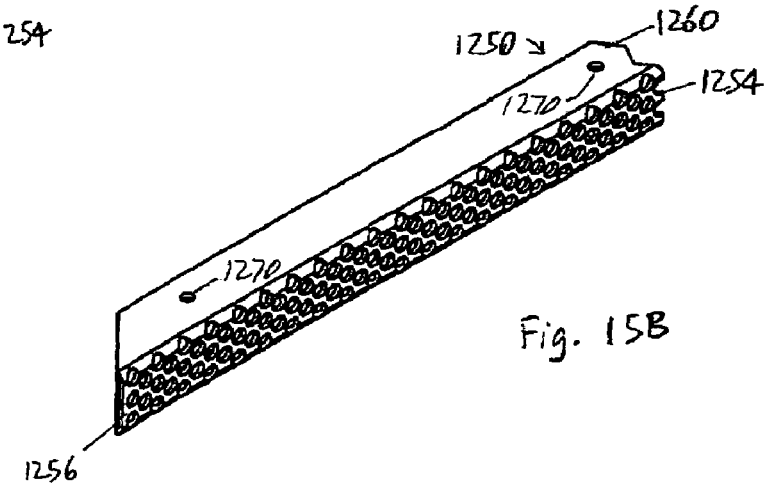
FIG. 15B is another isometric view of the housing of FIG. 15A.

In yet another alternative embodiment shown in FIGS. 15A-15C, a housing 1250 includes a substantially planar front wall 1254, with a substantially planar first wall 1260 extending therefrom substantially orthogonally to the front wall 1254. The front wall 1254 has an exterior side1256 and an opposed interior side 1258. Fastener holes 1270 are included in the first wall 1260. The housing 1250 additionally includes a second wall 1266 extending from the interior side 1258 of the front wall 1254. The second wall 1266 includes apertures 1267 which are substantially aligned with the fastener holes 1270 in the first wall 1260. The apertures 1267 permit fasteners to be passed there through and into the fastener holes 1270 when the housing 1250 is attached to the structure 68.

As can be seen in FIGS. 15A and 15C, the second wall 1266 preferably includes a first portion 1265 which is curved to receive the light source 52, and a second portion 1269 which extends towards the first wall 1260. As can be seen in FIG. 15C, the gap 1243 between the first wall 1260 and the second portion 1269 is substantially less than the diameter of the light source 52. As can be seen in FIG. 15C, in order for the light source 52 to be inserted in the housing 1250, the second portion 1269 is deflected (not shown), to enable the light source 52 to be inserted in the housing 1250. Because of the flexibility needed to enable the second portion 1269 to deflect sufficiently, the housing 1250 is preferably made of PVC or other suitable material with sufficient flexibility. After the insertion of the light source 52 through the gap 1243, the second portion 1269 returns to its original position (FIG. 15C) so that it holds the light source 52 in the housing 1250.

Figure 16A:
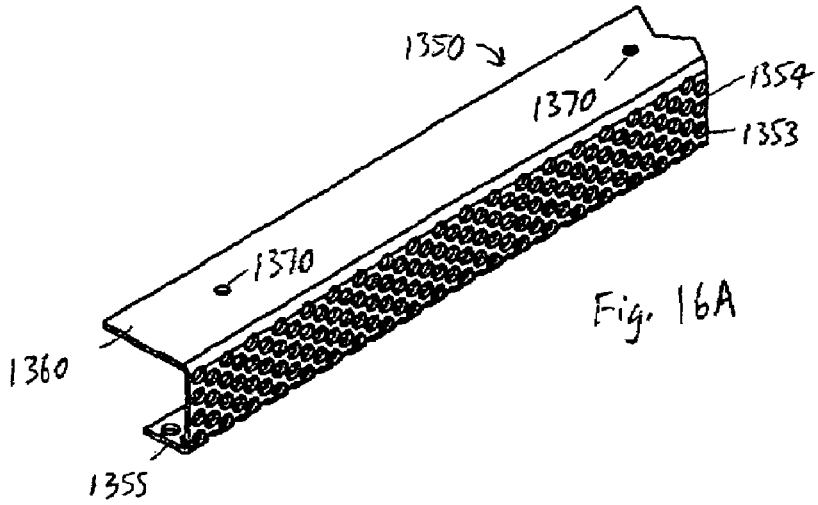
FIG. 16A is an isometric view of another alternative embodiment of the housing of the invention, drawn at a larger scale.
Figure 16C:
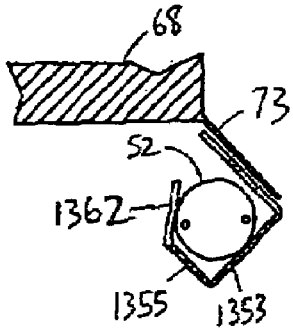
FIG. 16C is a cross-section of the housing of FIG. 16A attached to the structure and with the light source held therein, drawn at a smaller scale.
Figure 16B:
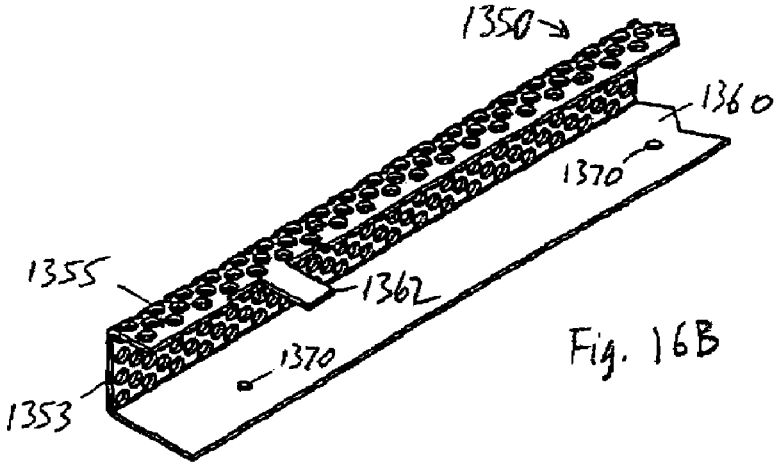
FIG. 16B is another isometric view of the housing of FIG. 16A.

In yet another alternative embodiment shown in FIGS. 16A-16C, a housing 1350 includes a front wall 1354 having a substantially planar first portion 1353 and a substantially planar second portion 1355 positioned orthogonally to the first portion 1353 and extending in a first direction therefrom. The housing 1350 additionally includes a first wall 1360 with fastener holes 1370 therein. Preferably, the housing 1350 additionally includes support elements 1362 movable between an open position (FIG. 16B) and a closed position (FIG. 16C).

As can be seen in FIG. 16C, the housing 1350 can be used where, for example, the structure 68 includes an extension part 73 to which the first wall 1360 is attached.

Figure 18B:
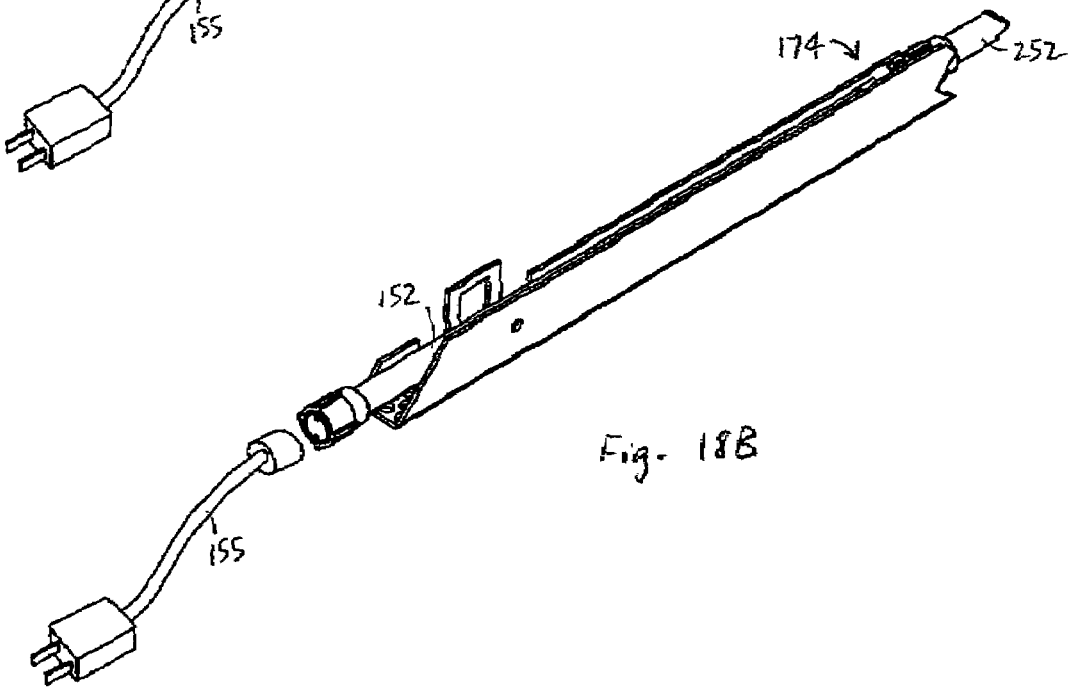
FIG. 18B is another isometric view of the housing and light assembly of FIG. 18A.

As shown in FIGS. 18A and 18B, a housing and light assembly 174 can be prepared for installation with a light source 152 having a predetermined length, and connectors 151, 153 at opposite ends thereof. Preferably, the connector 151 is adapted for use with an electrical power cord 155 to provide electricity to the light source 152 from a source (not shown). The connector 153 is preferably adapted to cooperate with a connector 251 positioned in a light source 252 in an adjacent housing portion (not shown). When the housing portions are positioned on the structure, the light sources 152 and 252 are joined together at the connectors 153, 251 so that electrical current can reach the light sources 152, 252. By means of such connectors, a series of housing portions, each containing a light source, can be connected together to form a decorative lighting system attached to a structure, such as a house.

Figure 19A:
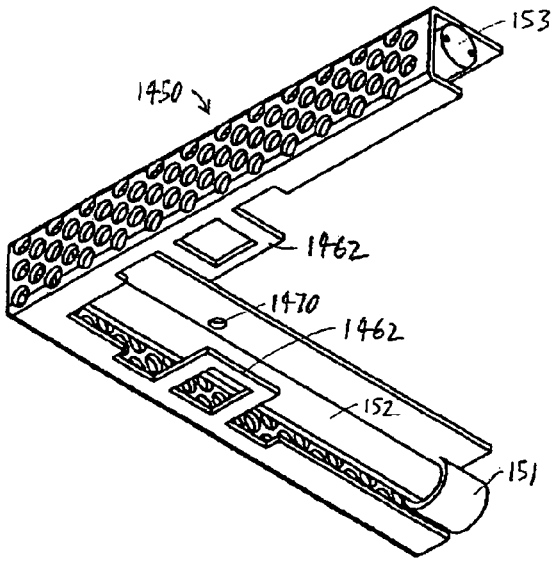
FIG. 19A is an isometric view of an alternative embodiment of a housing and light assembly of the invention.
Figure 19B:
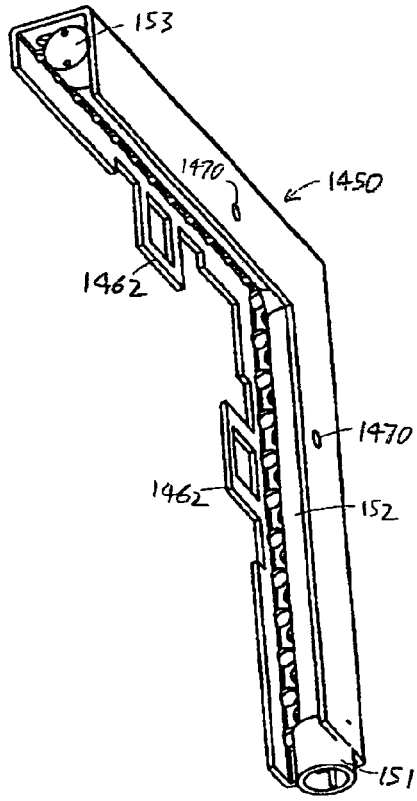
FIG. 19B is another isometric view of the housing and light assembly of FIG. 19A.

An additional embodiment 1450 of the housing is shown in FIGS. 19A and 19B, with the light source 152 positioned therein. The housing 1450 is formed to conform with a corner in a structure (not shown) to which the housing 1450 is to be attached. As can be seen in FIG. 19B, the housing 1450 includes fastener holes 1470 through which fasteners can be inserted in order to secure the housing 1450 to the structure. The housing 1450 also includes support elements 1462 which are shown in the open position in FIG. 19B for greater clarity.

The housing 1450 is preferably formed out of a substantially straight housing portion. After the dimensions of the corner in the structure are obtained, angled cuts re made in the front wall 1454 and in the second wall 1466. Preferably, the first wall 1460 is then bent to conform with the corner in which the housing 1450 is to be attached.

Figure 20A:
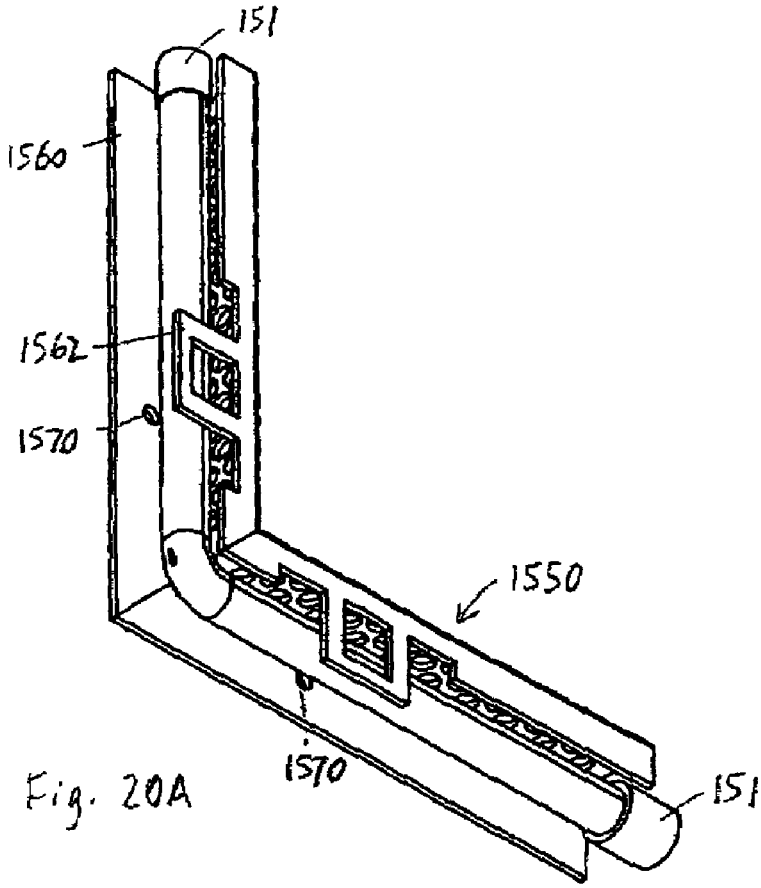
FIG. 20A is an isometric view of an alternative embodiment of a housing and light assembly of the invention.
Figure 20B:
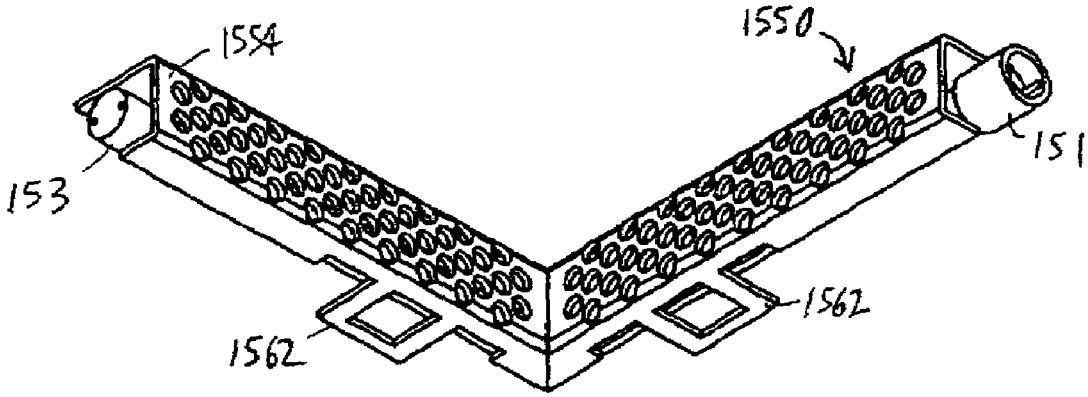
FIG. 20B is another isometric view of the housing and light assembly of FIG. 20A.

Another alternative embodiment of a housing 1550, with the light source 152 held therein, is shown in FIGS. 20A and 20B. The housing 1550 is formed to fit in an inwardly-directed 90° corner. The housing 1550 includes a first wall 1560 extending from a front wall 1554, and fastener holes 1570 are included in the first wall 1560. The support elements 1562 are shown in the open position for clarity. The housing 1550 preferably is formed by welding two housing potions (of suitable materials) together in the appropriate configuration.

Figure 21A:
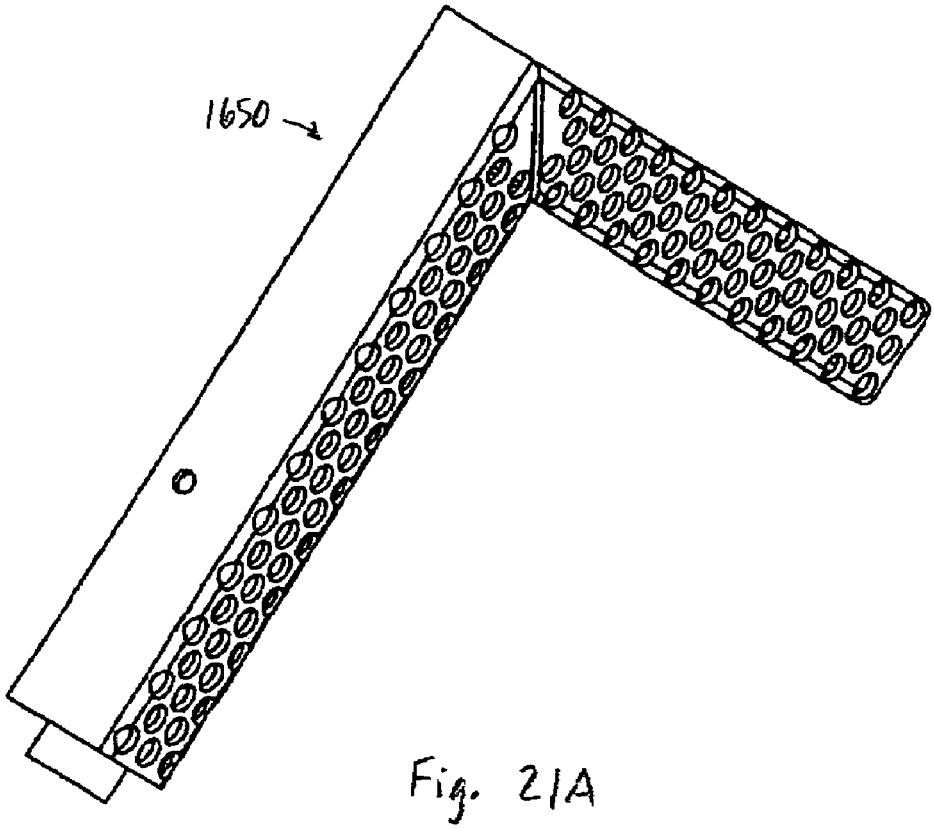
FIG. 21A is an isometric view of an alternative embodiment of a housing and light assembly of the invention.
Figure 21B:
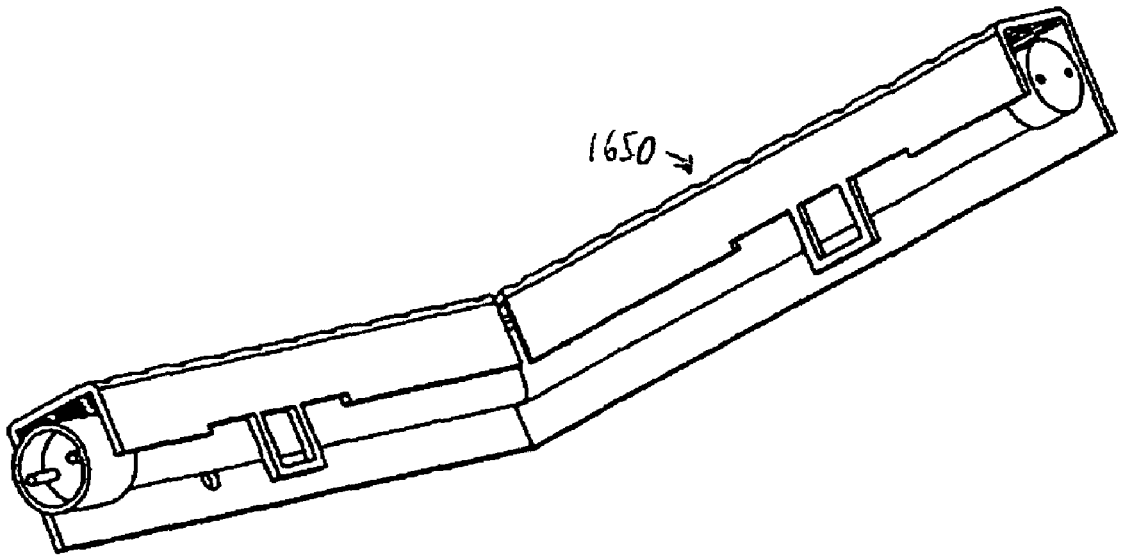
FIG. 21B is another isometric view of the housing and light assembly of FIG. 21A.

Yet another alternative embodiment of a housing 1650 is shown in FIGS. 21A and 21B. The housing 1650 is formed to fit into a peak on a structure 68. Preferably, the housing 1650 is made of a suitable material which can be bent into a shape and retain its shape afterwards, so that the housing 1650 can be formed to fit into a peak in a manner similar to the manner in which the housing 1450 is formed (described above).

The housing can be made of any suitable material. Preferably, the housing is made of material which is suitably resilient, where necessary, and otherwise which can be formed into the appropriate shapes, as required. The housing permits light to be directed from the light source positioned therein outwardly, through the front wall, and through an opening formed generally between the first wall and the second wall, i.e., in those embodiments of the housing which include a second wall. In the embodiments lacking a second wall, the opening is formed between the first wall and a distal end of the front wall. The result is to provide a decorative lighting system in which the observer can see light from the light source which is transmitted through the front wall as well as light simultaneously transmitted through the opening which provides a backlighting effect.

Figure 22A:
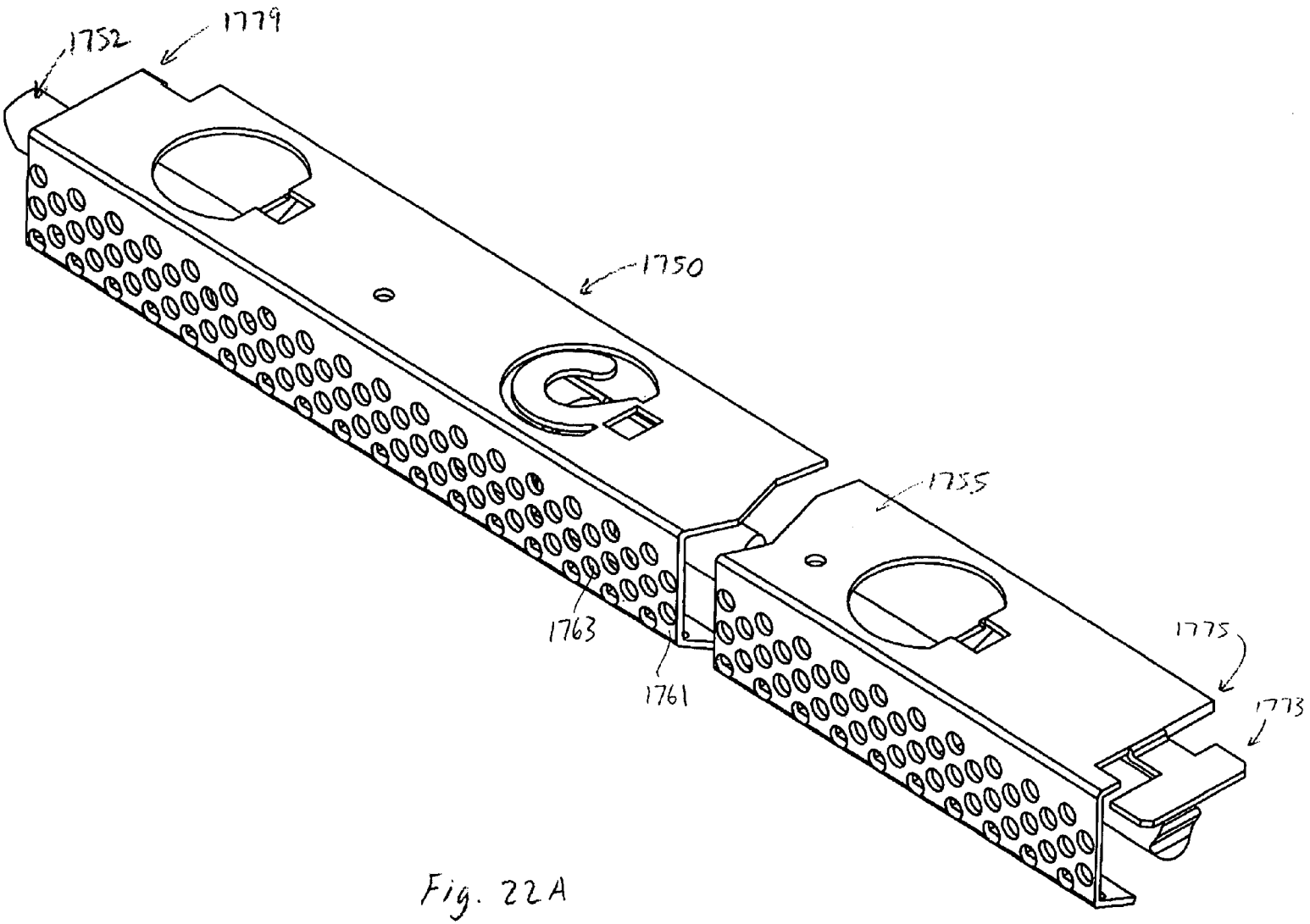
FIG. 22A is an isometric view of a housing and light assembly system of the invention including a housing and a light assembly, drawn at a larger scale.
Figure 22B:
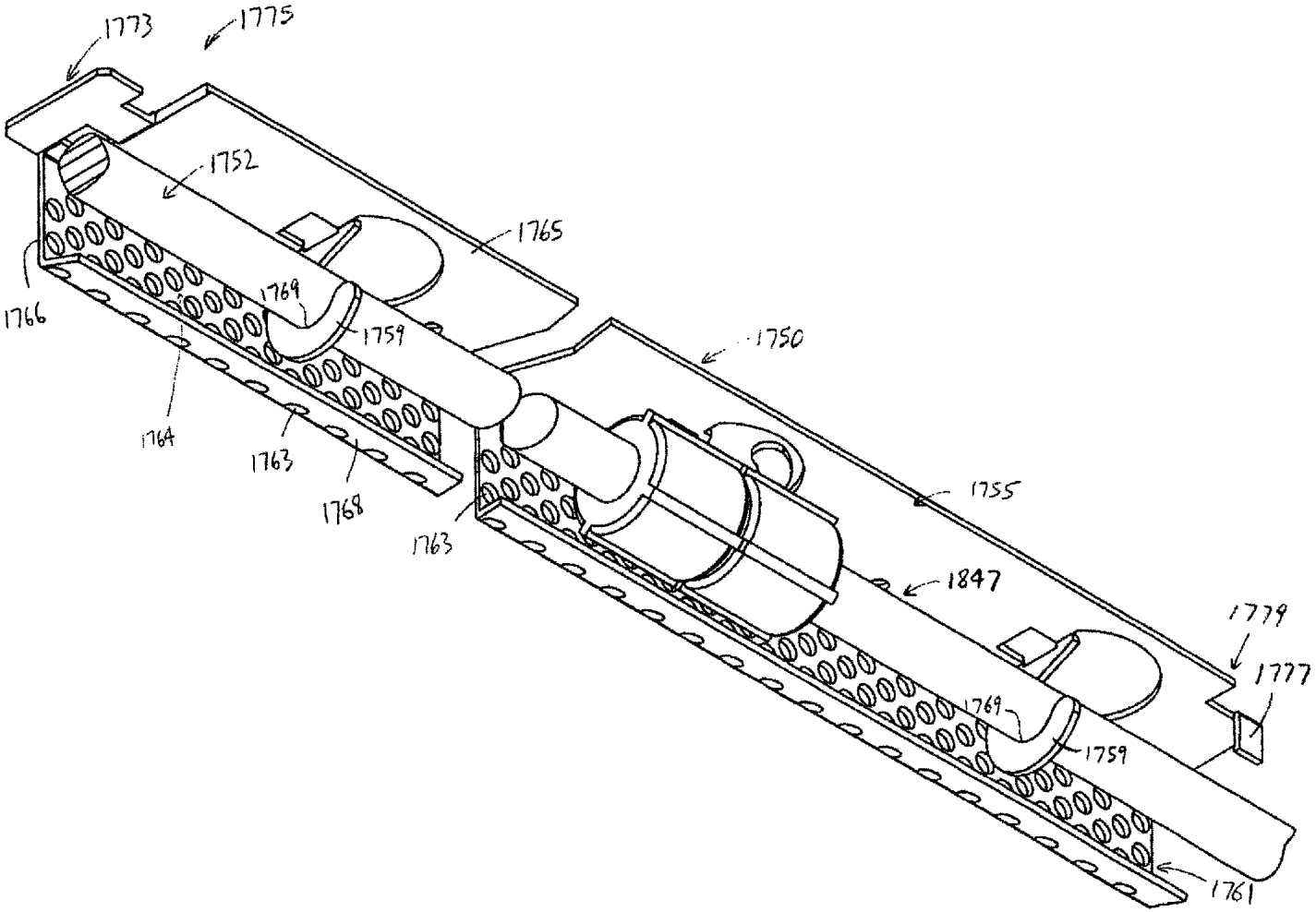
FIG. 22B is an isometric view of a body of the housing of FIG. 22A showing a channel defined by the body in the housing and the light assembly positioned therein.
Figure 23A:
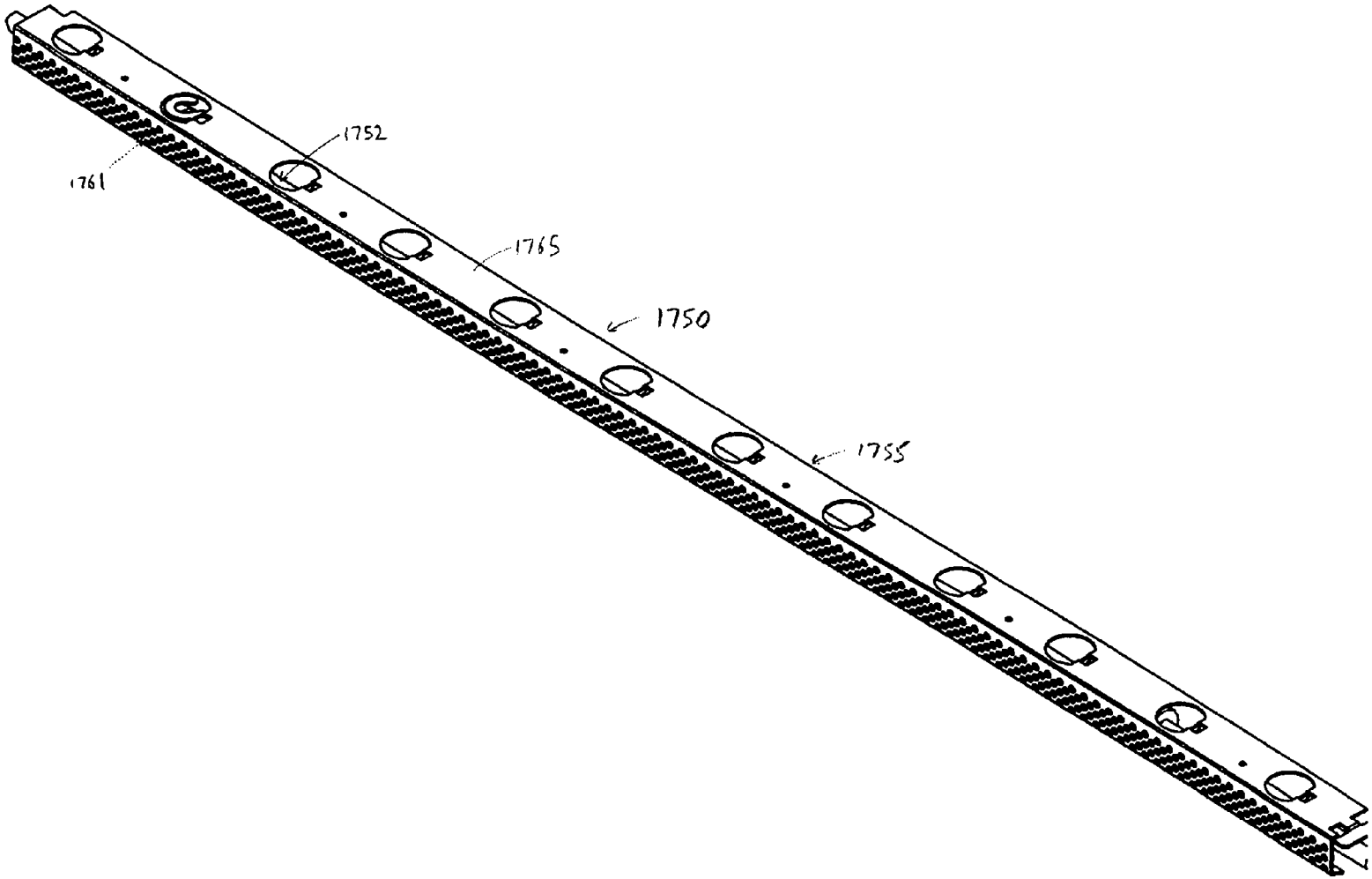
FIG. 23A is an isometric view of the housing and light assembly system of FIG. 22A, drawn at a smaller scale.
Figure 23B:
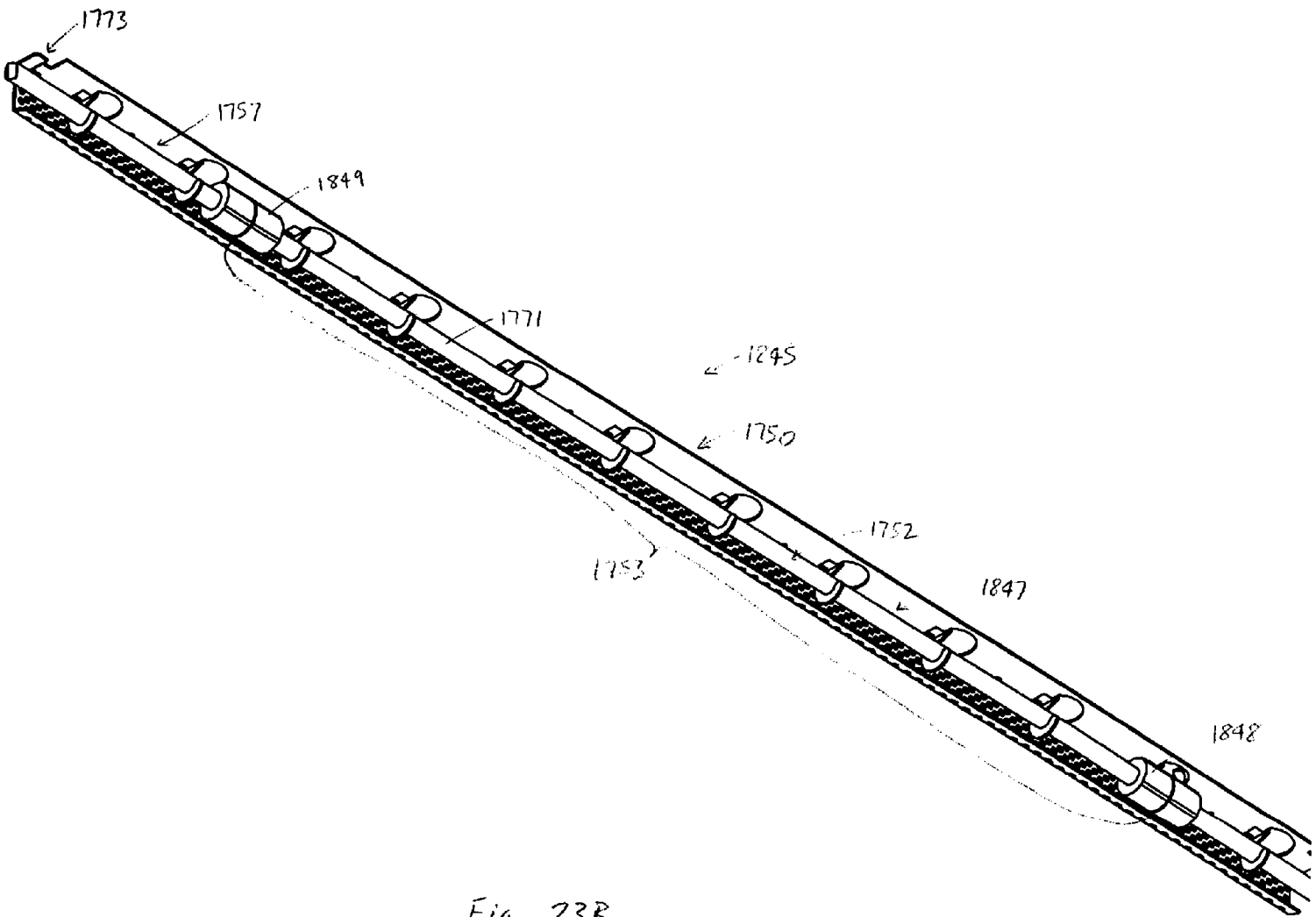
FIG. 23B is an isometric view of the housing and light assembly system of FIG. 23A showing the channel and the light assembly positioned therein.
Figure 24:
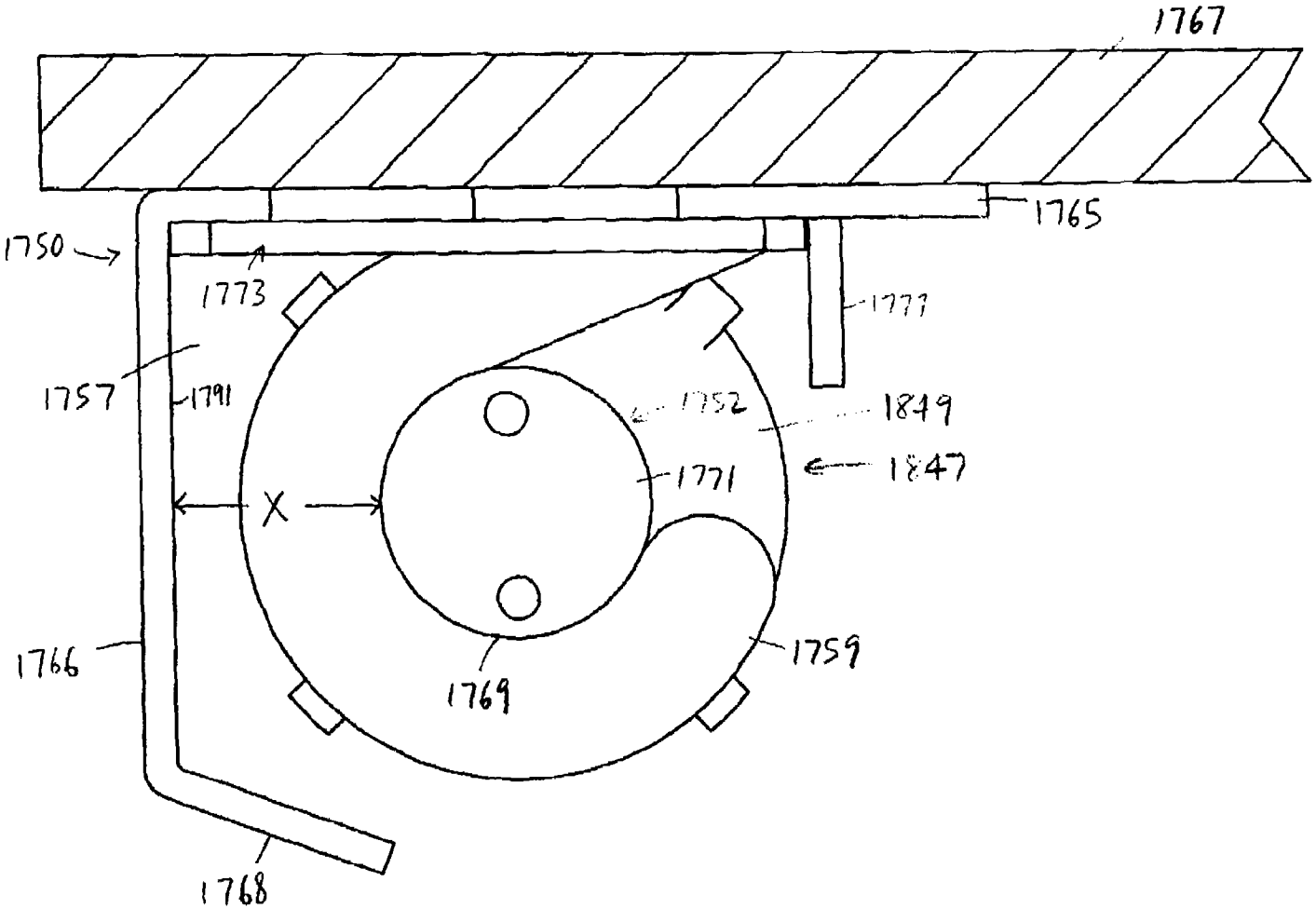
FIG. 24 is a side view of the housing and light assembly system of FIG. 22A, drawn at a larger scale.

Another alternative embodiment of a housing 1750 is shown in FIGS. 22-26 and 27A-27F. The housing 1750 is for holding one or more light sources 1752. As will be described, the light source 1752 includes a number of segments 1753 which preferably are connected to each other serially, or end-to-end. As shown in FIGS. 22-24, the housing 1750 includes a body 1755 defining a channel 1757. The housing 1750 also includes one or more support elements 1759 for positioning the light source 1752 in the channel 1757. In the preferred embodiment, the body 1755 includes an exposed portion 1761 with one or more light-transmitting parts 1763 through which light from the light source is transmittable, as will be described. The support elements 1759 are for locating the light source 1752 a preselected minimum distance "X" (FIG. 24) from the light-transmitting part 1763 of the exposed portion 1761.

Preferably, the body 1755 also includes a mounting portion 1765 for mounting the housing 1750 to a structure 1767 (FIG. 24), as will be described.

Figure 25:
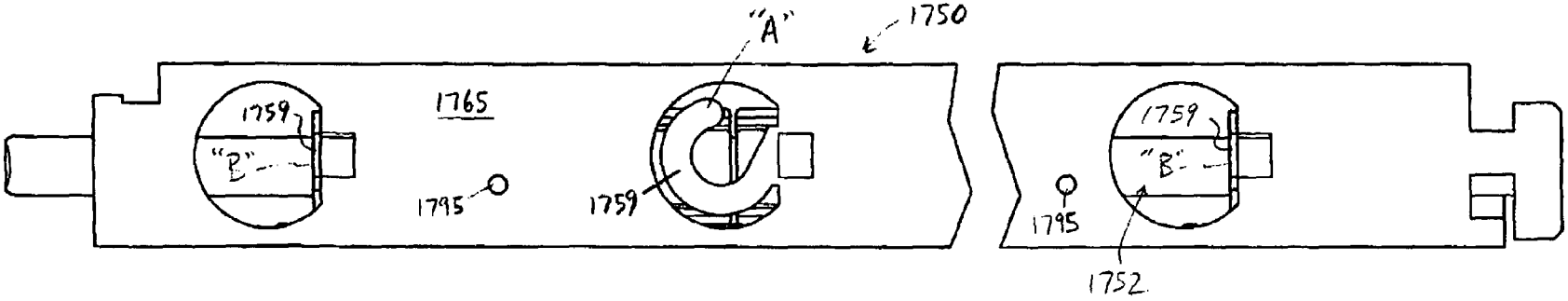
FIG. 25 is a top view of the housing and light assembly system of FIG. 22A, drawn at a smaller scale.
Figure 26:
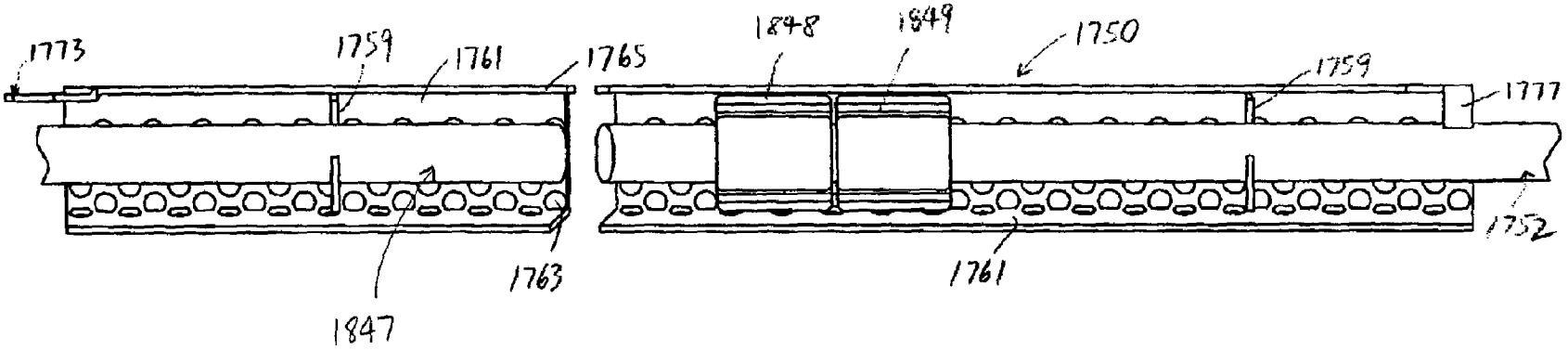
FIG. 26 is a back view of the housing and light assembly system of FIG. 22A.

As shown in FIG. 25, in the preferred embodiment, each support element 1759 is integrally formed in the mounting portion 1765 of the body. Preferably, each support element 1759 includes a receptacle part 1769 for receiving a main element 1771 of each segment 1753 of the light source 1752. The main element 1771 is preferably receivable in the receptacle part 1769 in a snap fit, as will be described.

As can be seen in FIG. 25, each support element 1759 is movable between an operational position, in which the support element 1759 extends from the mounting portion 1765 into the channel 1757, and a flattened position, in which the support element 1759 is substantially coplanar with the mounting portion 1765. In FIG. 25, a support element 1759 which is in the flattened position is designated by the letter "A", and support elements 1759 which are in the operational position (i.e., extending from the mounting portion 1765 into the channel 1757) are designated by the letter "B". Support elements 1759 in the flattened position and in the operational position are also shown in FIGS. 22A, 22B, 23A , and 23B. The support element 1759 shown in FIG. 24, for example, is in the operational position, and extends from the mounting portion 1765 into the channel 1757. The reason for moving certain support elements 1759 to the flattened position will be described further below.

Preferably, the exposed portion 1761 includes a first part 1764 (with light-transmitting parts 1763 therein) with an inside surface 1791 partially defining the channel 1757 (FIG. 24). The first part 1764 also includes a substantially planar front face 1766 positioned opposite to the inside surface 1791. Also, the exposed portion additionally includes a second part 1768, angled relative to the first part 1764. The second part 1768 preferably also includes light-transmitting parts 1763.

As indicated above, in the preferred embodiment, the light-transmitting parts are holes. Preferably, the holes are substantially circular and arranged in a regular pattern i.e. a pattern in which the holes are substantially equally spaced from each other. However, it will be understood that the holes could have any configuration desired. In addition, the light-transmitting parts need not be holes, but could be transparent, translucent, or partially transparent or translucent materials, having any shape. Any part which transmits light from the light source could function as a light-transmitting part. Also, the exposed portion could consist of the light-transmitting part. For example, the light-transmitting part could be a sheet (or sheets) of transparent or translucent (or partially transparent or partially translucent) material, or any combination thereof, and the sheet (or sheets) could also comprise the exposed portion, attached to the mounting portion.

In the preferred embodiment, the body 1755 includes a first tab 1773 at a first end 1775 thereof and a second tab 1777 (FIG. 23) at a second end 1779 thereof. The first and second tabs 1773, 1777 are adapted to mate with tabs in other bodies 1781 positioned adjacent to the first and second ends 1775, 1779 respectively, to locate the other bodies substantially in alignment with the body 1755, as shown in FIGS. 27A-27F.

In the preferred embodiment, the first tab 1773 includes an engagement portion 1783 connected to the mounting portion 1765 of the body 1755 by a bridge element 1785. As can be seen in FIG. 22, the bridge element 1785 and the engagement portion 1783 are generally positioned at a somewhat different elevation from the mounting portion 1765. Preferably, the bridge element 1785 and the engagement portion 1783 are positioned so that, when the first and second tabs 1773, 1777 of adjacent bodies are engaged, the first tab 1773 (i.e., the bridge element 1785 and the engagement portion 1783) of a first body are positioned below the mounting portion 1765 of a second (adjacent) body.

Figure 27A:
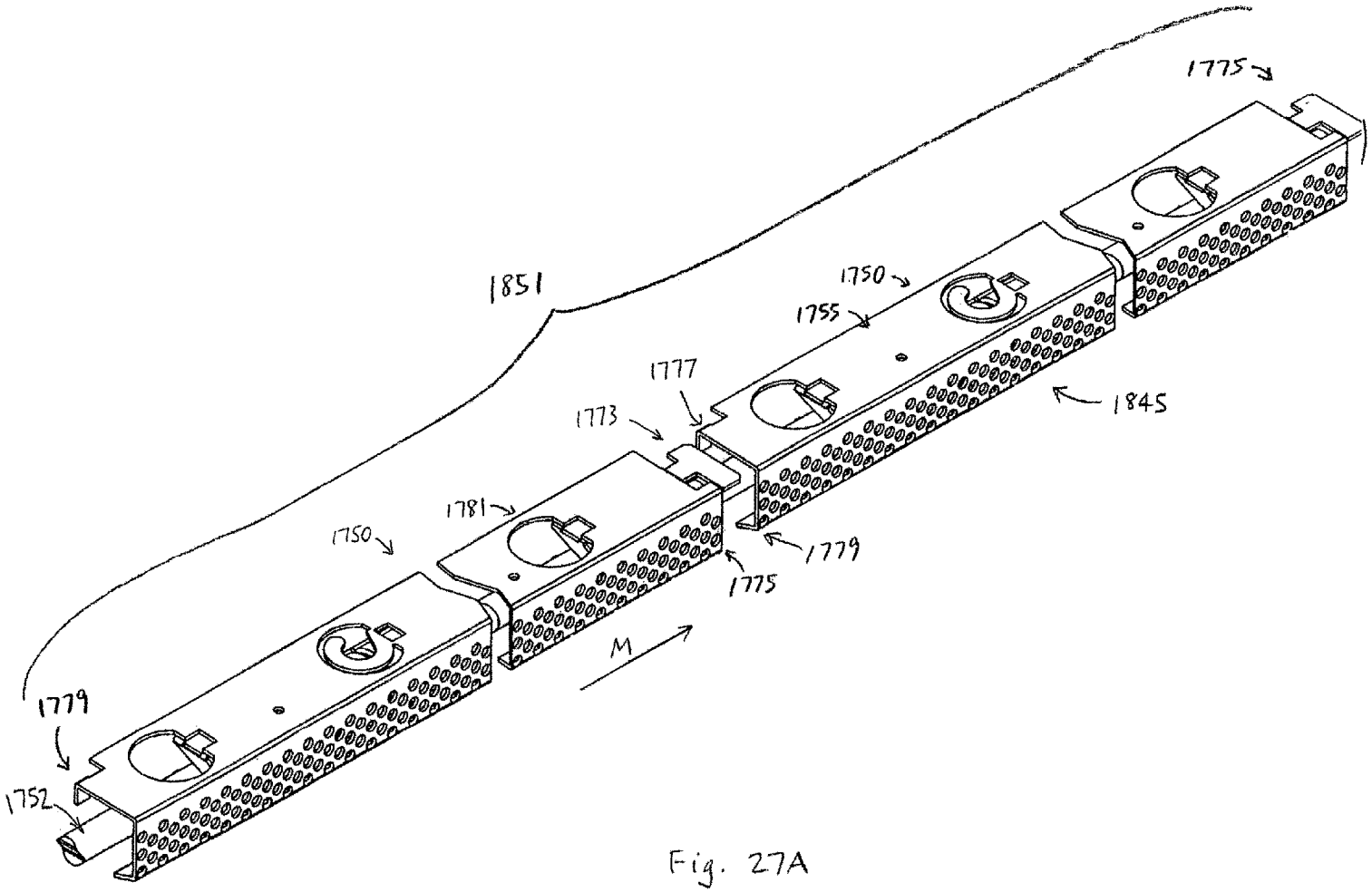
FIG. 27A is an isometric view of two adjacent bodies of a housing assembly in the housing and light assembly system of FIG. 22A with first and second tabs aligned for engagement.
Figure 27B:
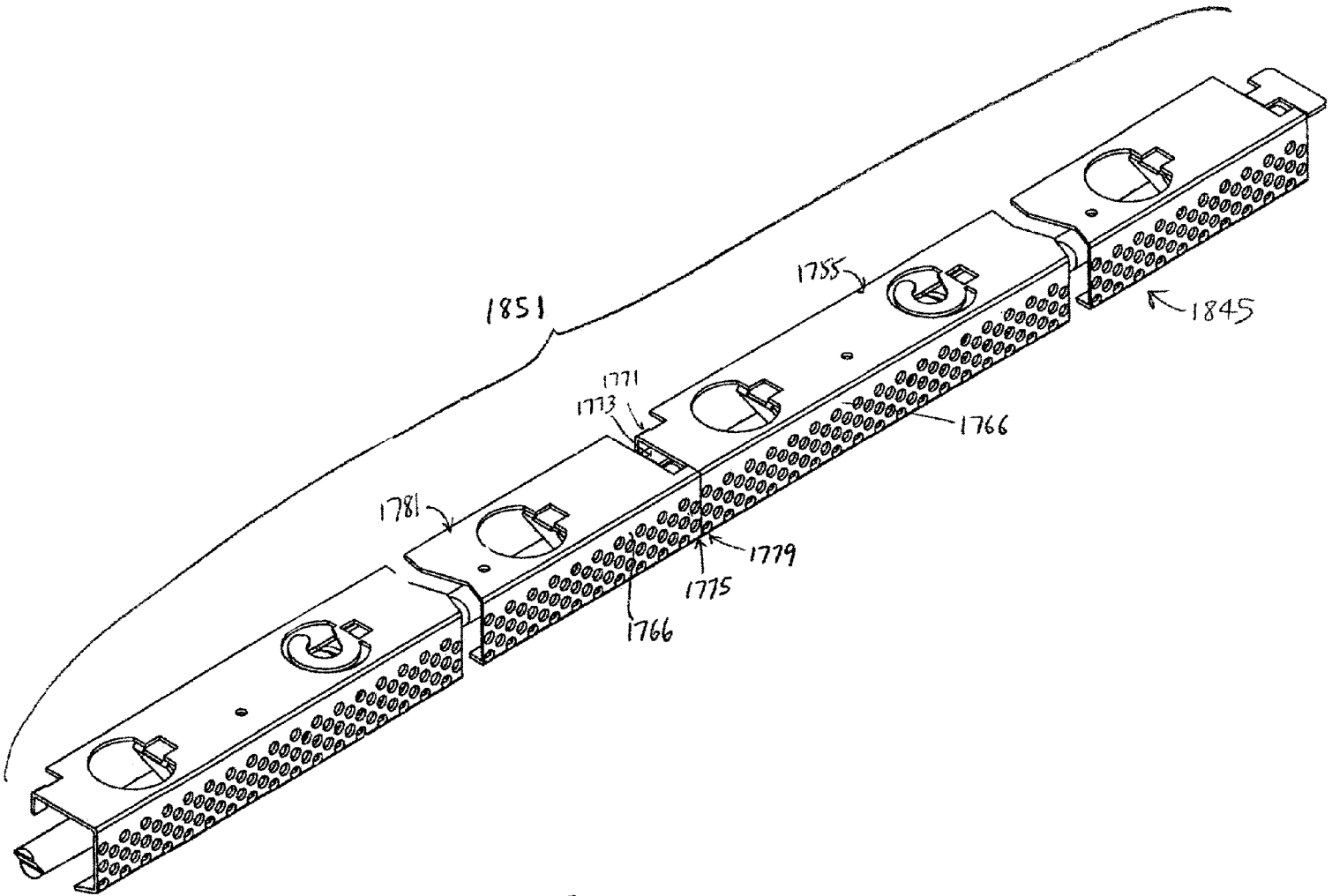
FIG. 27B is an isometric view of the two adjacent bodies of FIG. 27A showing the first and second tabs thereof engaged to substantially align the two adjacent bodies.
Figure 27C:
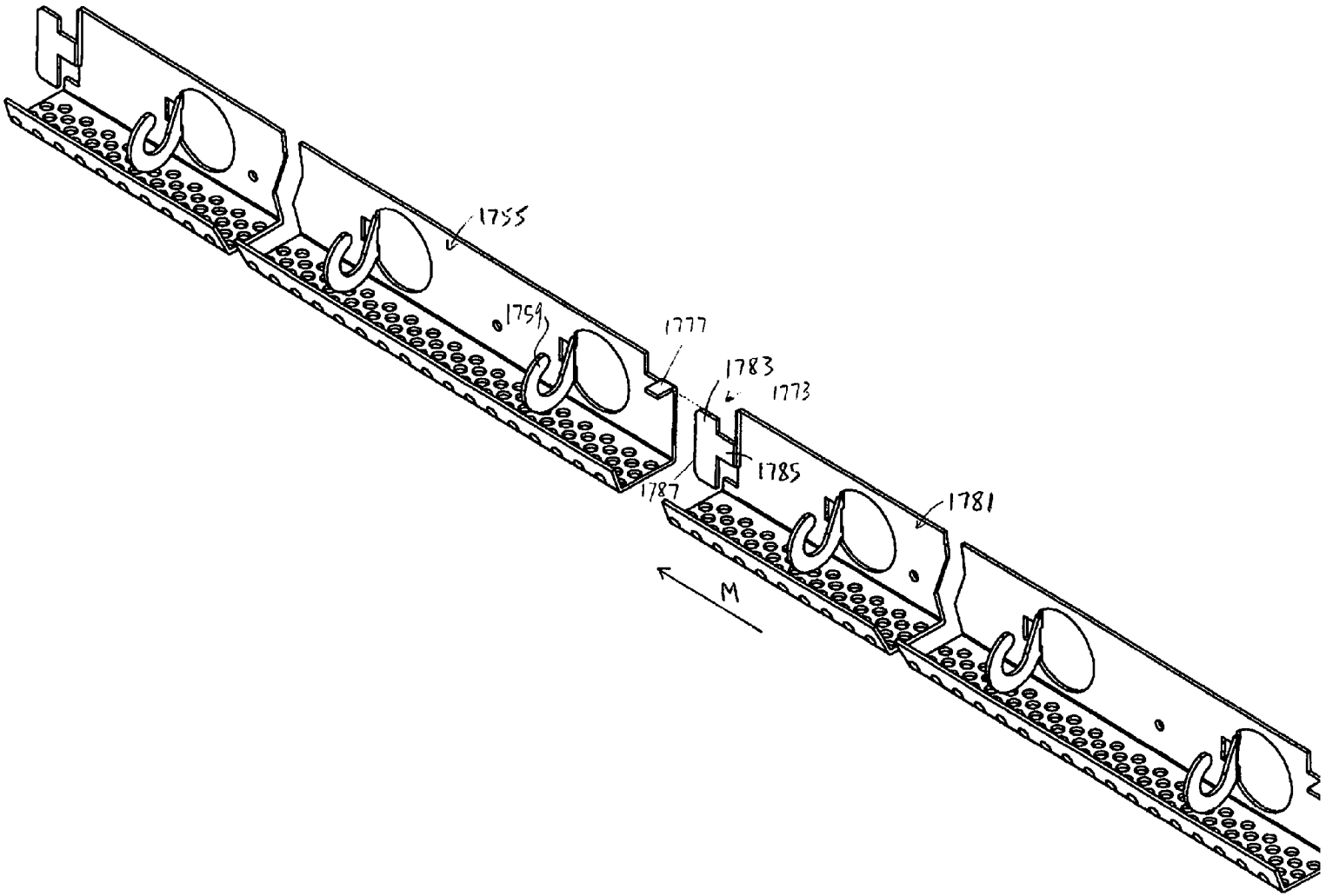
FIG. 27C is an isometric view of the two adjacent bodies of FIG. 27A without a light assembly positioned in the channel, with the first and second tabs aligned for engagement.
Figure 27D:
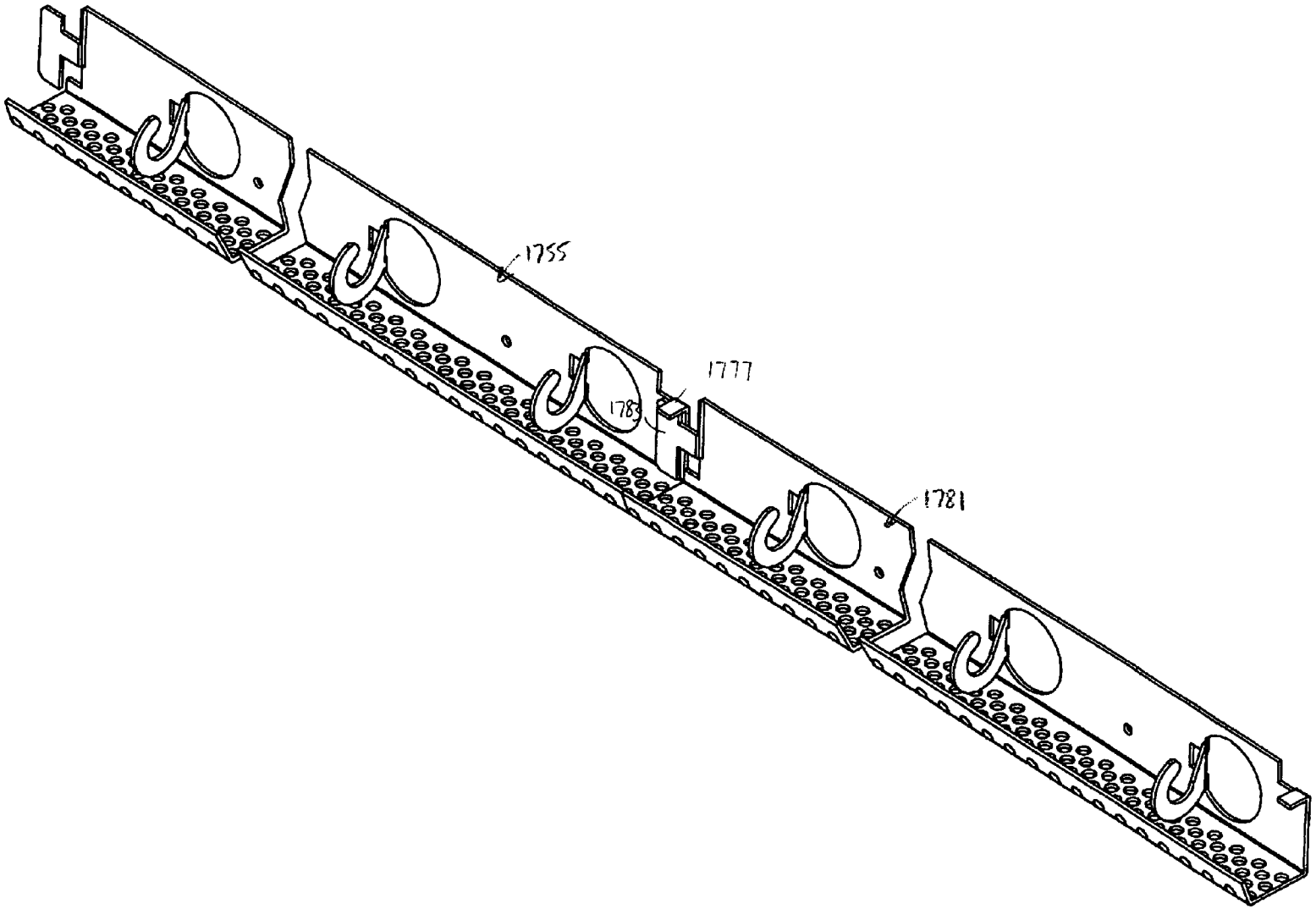
FIG. 27D is an isometric view of the two adjacent bodies of FIG. 27C with the first and second tabs engaged.
Figure 27E:
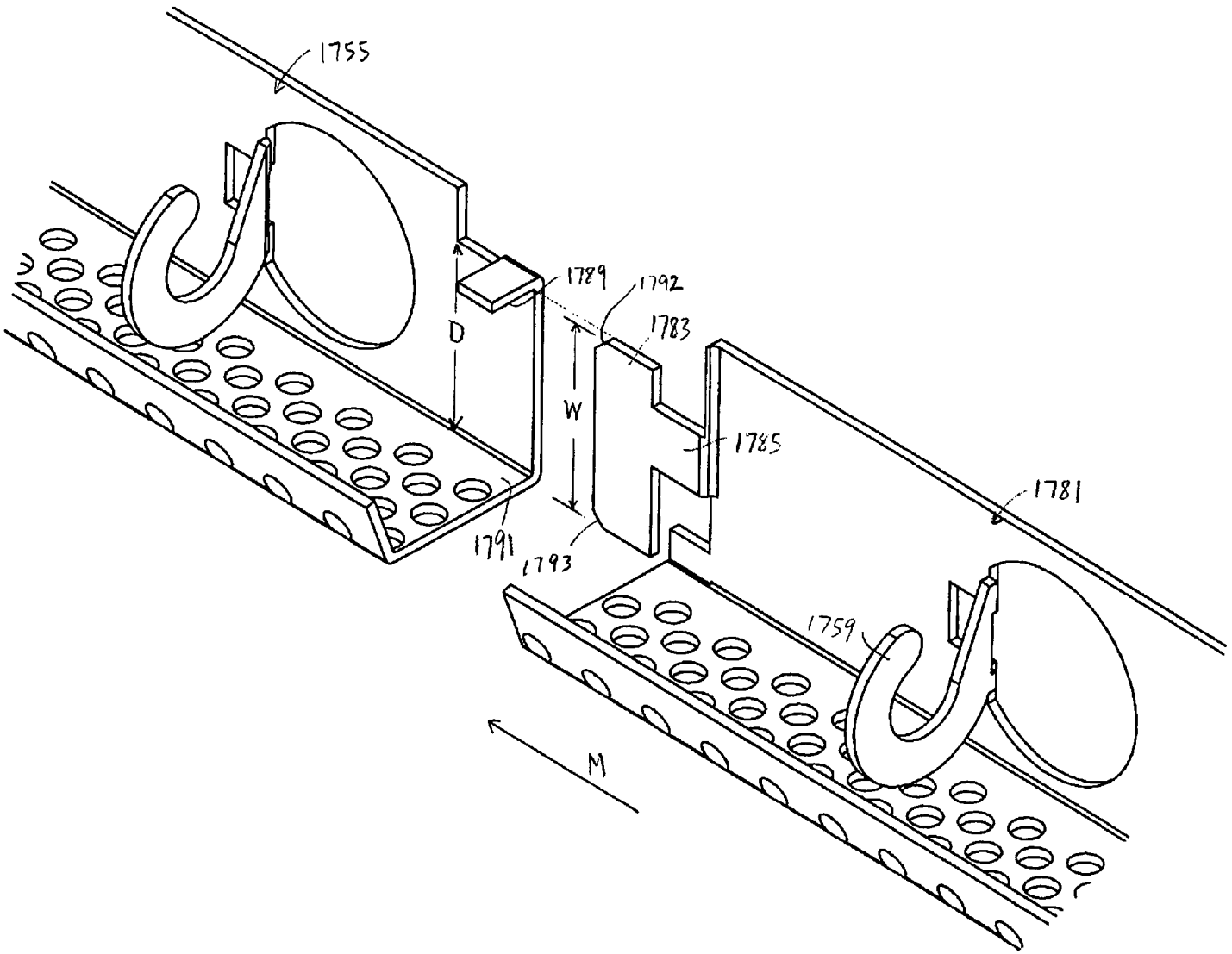
FIG. 27E is an isometric view of the two adjacent bodies of FIG. 27C, drawn at a larger scale.
Figure 27F:
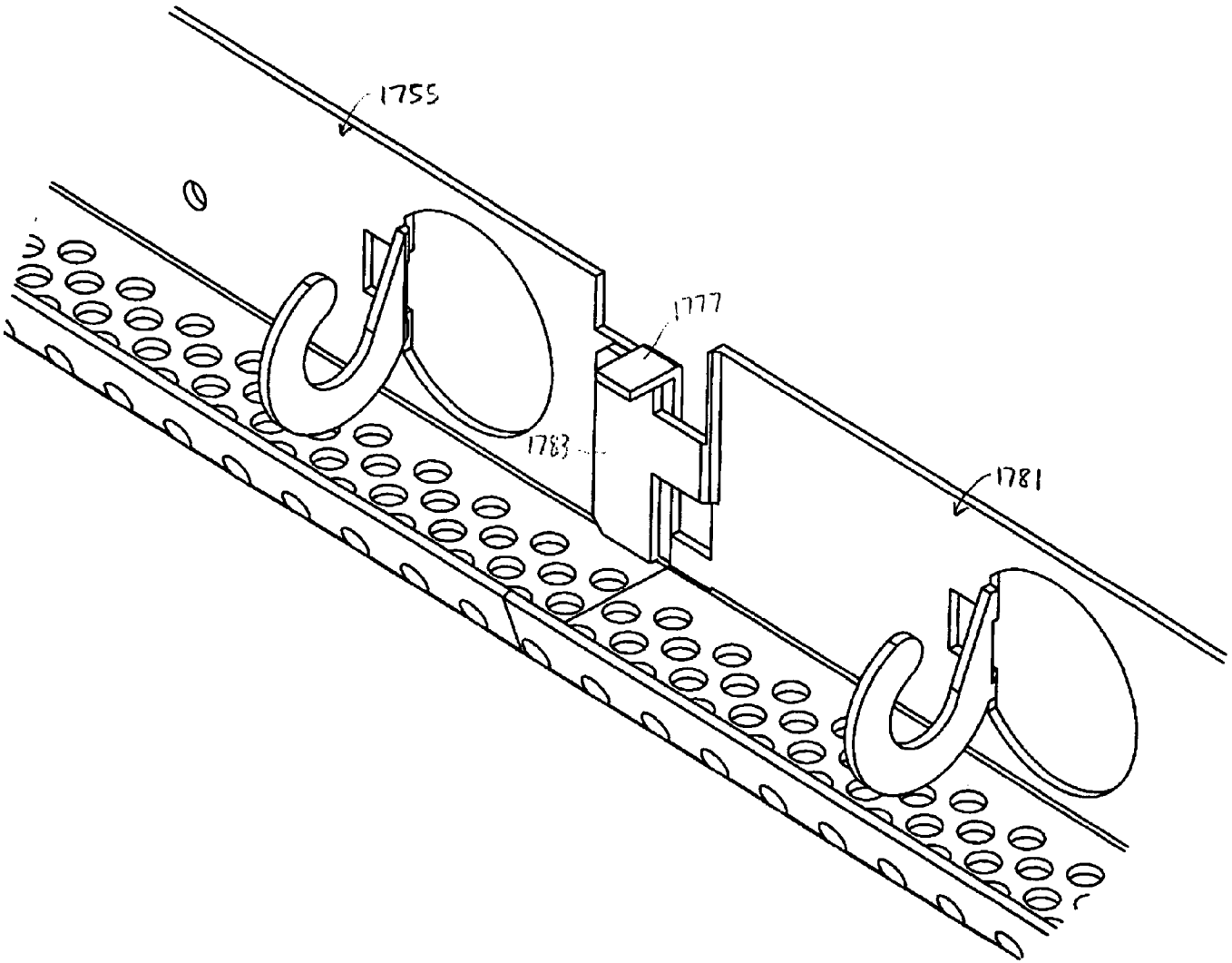
FIG. 27F is an isometric view of the two adjacent bodies of FIG. 27D.
Figure 28:
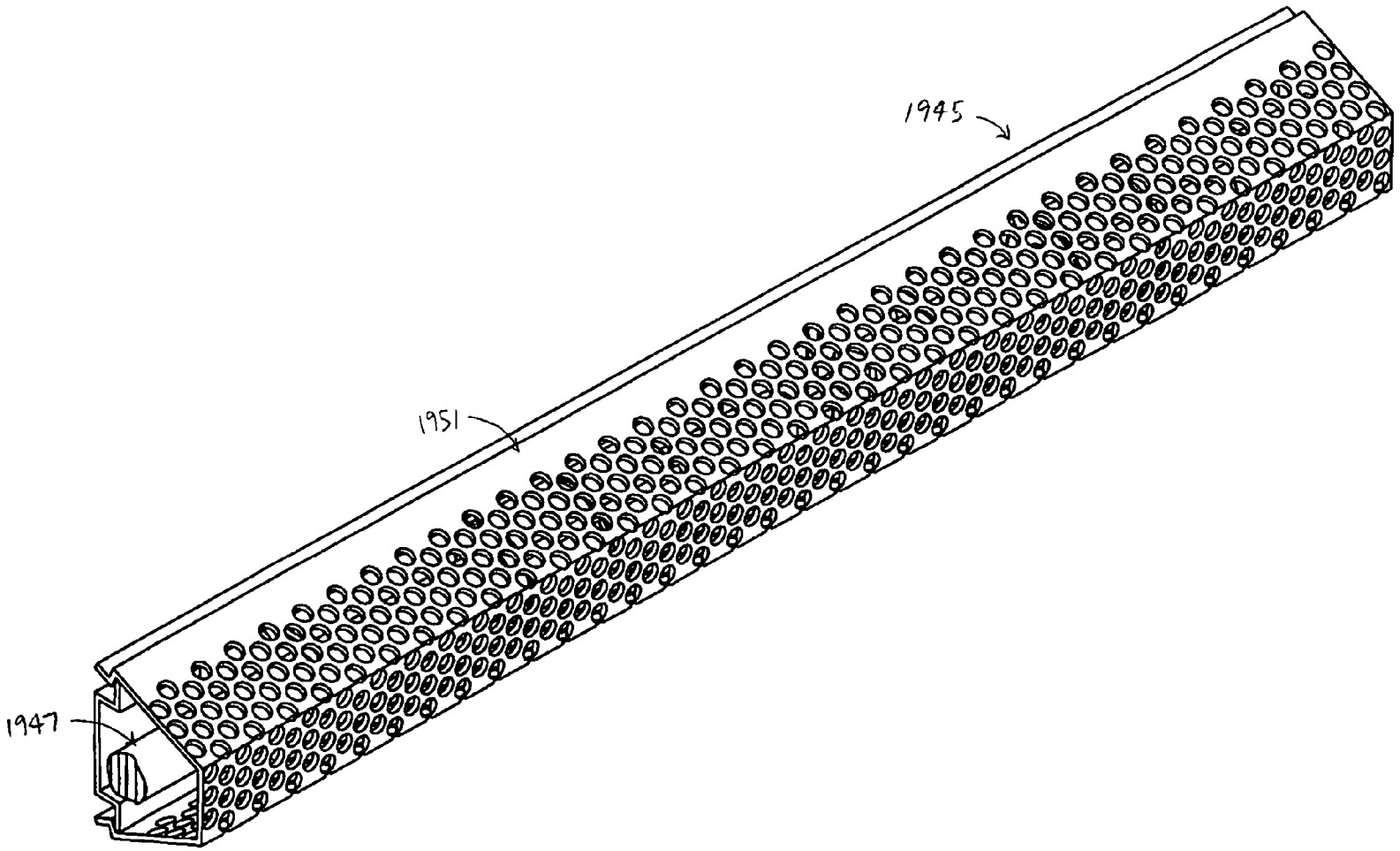
FIG. 28 is an isometric view of another alternative embodiment of a housing and light assembly system of the invention, drawn at a smaller scale.

As shown in FIG. 27E, the engagement portion 1783 preferably has a width "W" across its end 1787 which is less than a distance "D" between the second tab 1777 and the exposed portion 1761. More specifically, the distance "D" is the distance by which an inner surface 1789 of the second tab 1777 is spaced apart from an inside surface 1791 of the exposed portion 1761. In the preferred embodiment, the inner surface 1789 is substantially planar, and the inner surface 1789 and the inside surface 1791 are substantially parallel to each other, defining a slot. Because the width (W) of the engagement portion is only slightly less than the distance (D), the engagement portion 1783 slides between the surfaces 1789, 1791, to fit therebetween in a sliding clearance fit when the first tab 1773 and the second tab 1777 are engaged.

As shown in FIGS. 27A-27F, the engagement of the first tab in one body with the second tab in another body results in substantial alignment of the front faces 1766 of the bodies 1755,1781 with each other.

The engagement portion 1783 preferably also includes chamfered corners 1792, 1793, as shown in FIG. 27E. The corners 1792, 1793 of the engagement portion 1783 are chamfered, or cut on angles, in order to enable the engagement portion 1783 to be slid relatively easily into the slot between the second tab 1777 and the exposed portion 1761.

As shown in FIGS. 22-26 and 27A-27B, a preferred embodiment of a housing and light assembly system 1845 includes a light assembly 1847 including a plurality of segments 1753 connected end-to-end. Each segment 1753 includes a main element 1771, a first connector 1848, and a second connector 1849. The main element 1771 extends between the first connector 1848 and the second connector 1849. The connectors 1848, 1849 are positioned at the ends of each segment 1753 respectively. Preferably, the light source 1752 is the light assembly 1847. In the preferred embodiment, the light is provided by a plurality of small incandescent electric light bulbs positioned inside the main element 1771. However, it will be understood that other types of lighting devices could be used as the light source.

As shown in FIGS. 27A-27F, the housing and light assembly system 1845 also preferably includes a housing assembly 1851 including a plurality of bodies 1755, 1781 defining at least one channel 1757. Preferably, the housing assembly 1851 includes a plurality of support elements 1759 for locating the light source 1752 in the channel 1757. Each body 1755 includes an exposed portion 1761 including one or more light-transmitting parts 1763 through which light from the light source 1752 is transmittable. Each main element 1771 is positioned by support elements 1759 in the channel 1757 and is spaced apart from the light-transmitting parts 1763 by a preselected minimum distance. Because of the separation of the main element 1771 from the light-transmitting parts 1763, the light source 1752 appears to provide a sparkling, or glittering light when observed by an observer (not shown) who is moving relative to the housing and light assembly system 1845.

Preferably, each body 1755 includes a mounting portion 1765 adapted to be secured to a structure 1767. It is also preferred that the support elements 1759 are integrally formed in each body 1755 respectively. Also, it is preferred that each support element 1759 includes a receptacle part 1769 for receiving the main element 1771 in a clearance fit.

In use, an installer (not shown) first places the mounting portion 1765 of the body 1755 on the structure 1767 and fastens the body 1755 thereto. In the preferred embodiment, the mounting portion 1765 includes one or more holes 1795 therein through which a fastener (not shown)—e.g., a nail, a screw, or any other suitable fastening device—preferably is inserted to secure the mounting portion 1765 (and hence the body 1755) to the structure 1767. Once the body 1755 is secured to the structure 1767, the installer can position the main element 1771 in the receptacle parts 1769 of support elements 1759, except where the connectors 1848, 1849 obstruct movement of the support elements 1759 to be moved to the operational position.

As can be seen in FIG. 23B, each segment 1753 of the light assembly 1847 preferably ends in a connector 1848, 1849. The connector 1848 mates with the connector 1949 to provide electrical connection from one segment 1753 to the next. In this way, electrical current from a source (not shown) is ultimately provided along the length of the light assembly 1847. It will be appreciated that the connectors 1848, 1849 are required by safety regulatory authorities to be configured in the manner shown. However, the outer diameters of the connectors 1848, 1849 are substantially larger than the diameter of the main element 1771. Therefore, where a support element 1759 interferes with the positioning of connectors 1848, 1849 in the channel, the support element 1759 is moved to the flattened position (e.g., support element "B" in FIG. 25).

As noted above, the support elements 1759 preferably are formed integrally with the body 1755. Also, the housing 1750 preferably is made of a suitable metal, formed by stamping and punching operations. Preferably, each support element 1759 is placed in the operational position as part of the process of manufacturing the housing 1750. Each support element 1759 which is to be moved to the flattened position thus can relatively easily be so moved by the installer during installation. Also, because of the integral construction of the support element with the body 1755, each support element 1759 which is in the operational position remains firmly in position and securely holds the main element of the light assembly in position once installed.

Preferably, the receptacle part 1769 is configured so that the main element 1771 fits into the receptacle part 1769 in a "snap" fit. This is desirable because, for the convenience of the installer, a snap fit enables the relatively quick positioning of the main element 1771 in the support element 1759 in a relatively secure fashion. However, because the main element 1771 fits in the support element 1759 in a snap fit, the main element 1771 also can be relatively easily removed. In practice, although rope lights tend to last a relatively long time, replacement of a segments from time to time is likely to be required. The snap fit feature permits relatively easy replacement of a segment when necessary.

After the body 1755 has been secured to the structure 1767, the other body 1781 is brought adjacent to the body 1755. The body 1781 is moved in the direction of arrow "M" (FIGS. 27A, 27C, 27E) so that the first tab 1773 engages the second tab 1777. As described above, when the first tab 1773 and the second tab 1777 are engaged, the front faces 1766 of the bodies 1755, 1781 are substantially aligned, resulting in an aesthetically pleasing appearance. With the body 1781 thus positioned, the body 1781 is secured to the structure. After the body 1781 has been secured, the light source 1752 is placed therein, i.e., as many support elements 1759 in the body 1781 as can be moved to the operational position are so moved, and the main element is received in the receptacle parts of the support elements 1759 in the other body 1781 in a snap fit.

Although the mounting portion 1765 is shown in FIG. 24 as being secured to a substantially horizontal structure 1767, it will be understood that the mounting portion can be attached to a structure in any position. Accordingly, any directional references herein should be understood as being solely for the purposes of illustration of one of many ways in which the housing 1750 can be used, and not as limitations.

Also, it will be understood that any suitable means for fastening the mounting portion 1765 to the structure could be used. For example, any suitable glue or adhesive could be used. Alternatively, brackets (not shown) could be used to fasten the mounting portion 1765 to the structure 1767.

As with other embodiments of the housing noted above, the housing can be cut into an appropriate length in order to fit onto a structure. Also, the housing can also be configured into angular shapes or curved shapes, as required to fit onto a structure. For example, where a structure includes a-corner substantially defining a right angle, a length of housing configured to fit onto such right angle is used.

Another alternative embodiment of a housing and light assembly system 1945 is shown in FIGS. 28-36. The housing and light assembly system 1945 preferably includes a light assembly 1947 and a housing assembly 1951. The light assembly 1947 includes a plurality of segments 1953 connected serially or end-to-end. Each segment 1953 includes a main element 1971, a first connector 1948, and a second connection 1949. The main element 1971 extends between the first connection 1948 and the second connector 1949. The first and second connectors 1948, 1949 are positioned at the respective ends of each segment 1953. Preferably, the light source 1952 is the light assembly 1947. In the preferred embodiment, the light is provided by a plurality of small incandescent electric light bulbs positioned inside the main element 1971. However, it will be understood that other types of lighting devices could be used as the light source.

Figure 29:
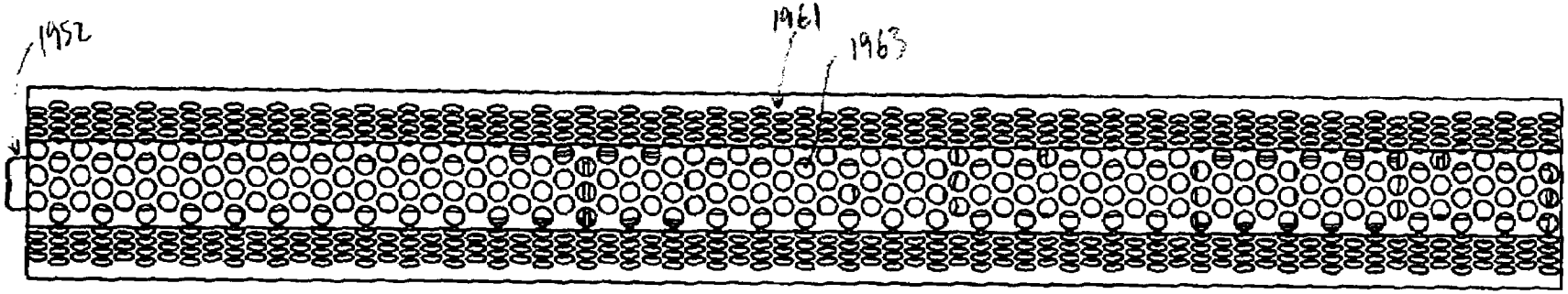
FIG. 29 is an elevation view of the system of FIG. 28 showing an exposed portion of a housing thereof, drawn at a smaller scale.
Figure 30:
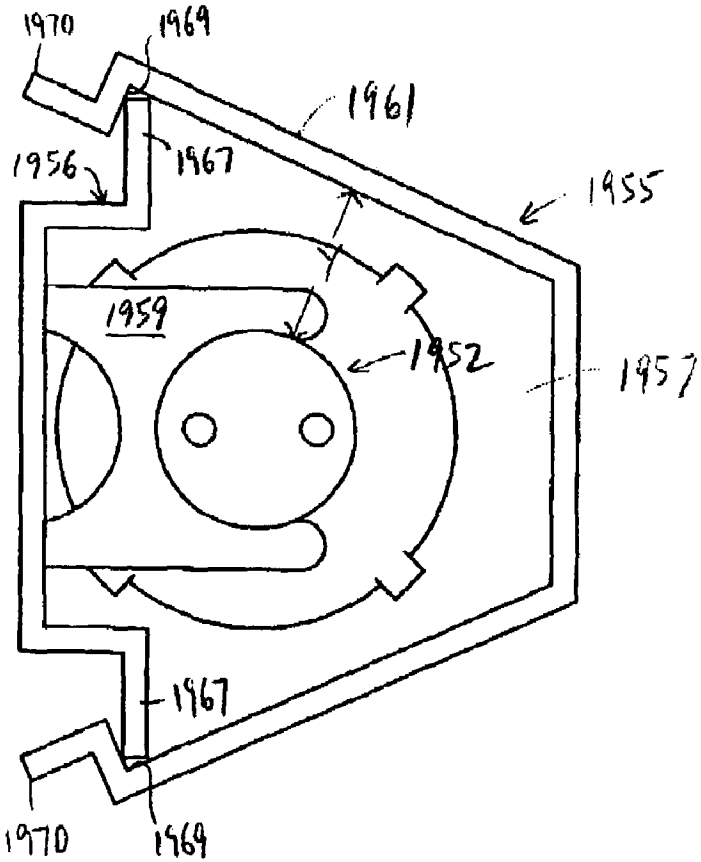
FIG. 30 is a side view of the housing and light assembly system of FIG. 28 showing the housing mounted on a base and a light source positioned on the base, drawn at a larger scale.
Figure 31:
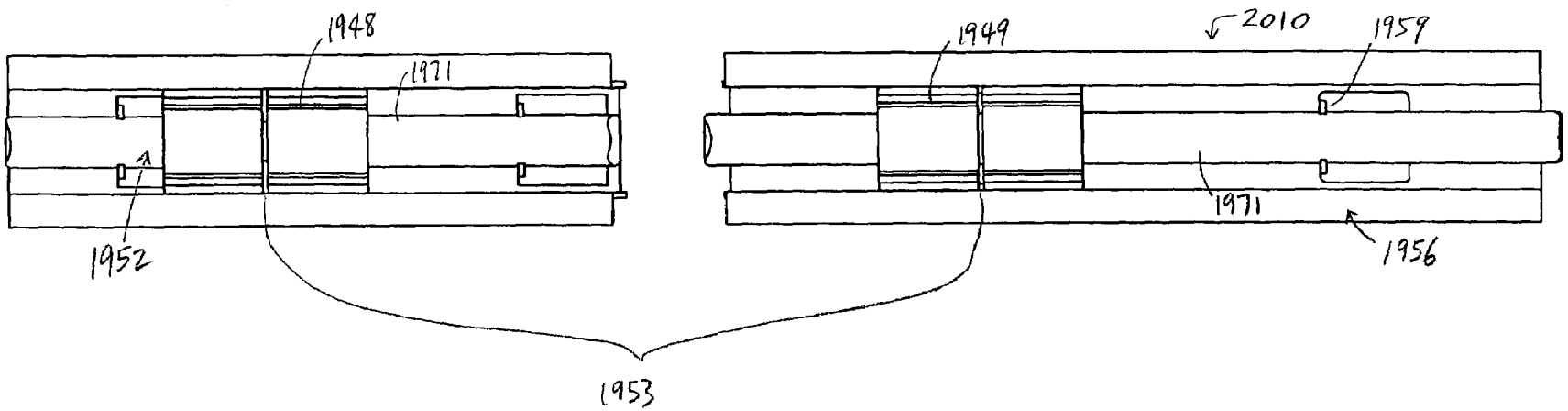
FIG. 31 is an elevation view of a front side of a preferred embodiment of the base with the light assembly mounted thereon, drawn at a smaller scale.

The housing assembly 1951 includes one or more bases 1956 adapted to be secured to a structure 1967 (FIG. 33), and one or more bodies 1955 attachable to the base 1956. Each body 1955 defines at least one channel 1957 as will be described. The base 1956 includes a plurality of support elements 1959 for locating the light source 1952 in the channel 1957 when the body 1955 is attached to the base 1956 (FIG. 30). The body 1955 includes an exposed portion 1961 including one or more light-transmitting parts 1963 through which light from the light source 1952 is transmittable (FIG. 29). Each main element 1971 is positioned by the support elements 1959 in the channel 1957 spaced apart from the light-transmitting parts 1963 by a preselected minimum distance "Y" (FIG. 30). Because of the separation of the main element 1971 from the light-transmitting parts 1963, light from the light source 1952 appears to an observer (not shown) moving relative to the housing and light assembly 1945 to be sparkling, or glittering.

Preferably, the body 1955 includes one or more mounting portions 1965 adapted to cooperate with the base 1956 to secure the body 1955 to the base 1956. In the preferred embodiment, the mounting portion 1965 is securable to the base 1956 in a clearance fit, as will be described. It is also preferred that the channel 1957 is sufficiently large to accommodate the connectors 1948, 1949 included in the light source 1952.

In use, the base 1956 is secured to the structure 1967 by any suitable means. For example, holes (not shown) in the base 1956 may be formed to receive fasteners (not shown) to fasten the base 1956 to the structure 1967. After the base 1956 is secured to the structure 1967, the light assembly 1947 is positioned on the base 1956, i.e., the light source 1952 is positioned in the support elements 1959.

Preferably, the support elements 1959 are configured so that the main element 1971 is receivable in the support elements 1959 in a snap fit. The snap fit feature has the benefit that it enables the light assembly to be mounted on the base 1956 relatively securely, and relatively easily. Also, replacement of a segment 1953 (i.e., if the segment is malfunctioning) is relatively easy because of the snap fit feature.

Figure 32A:
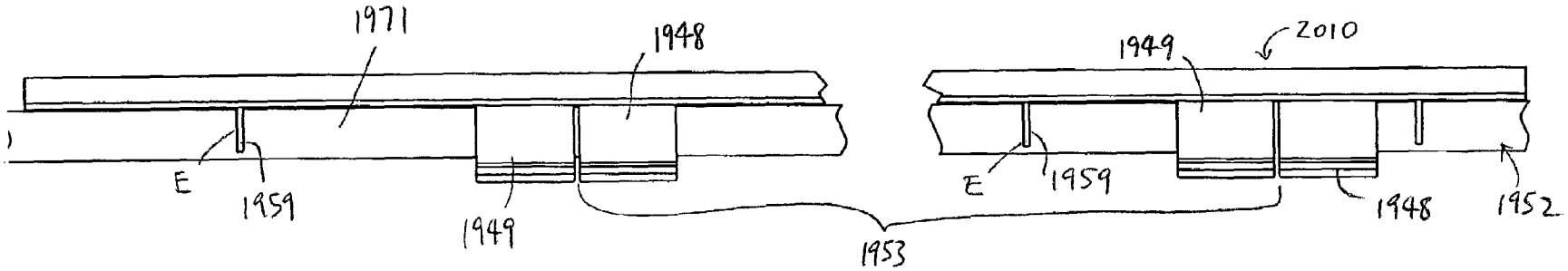
FIG. 32A is a top view of the base of FIG. 31, with the light assembly in position thereon.
Figure 32B:
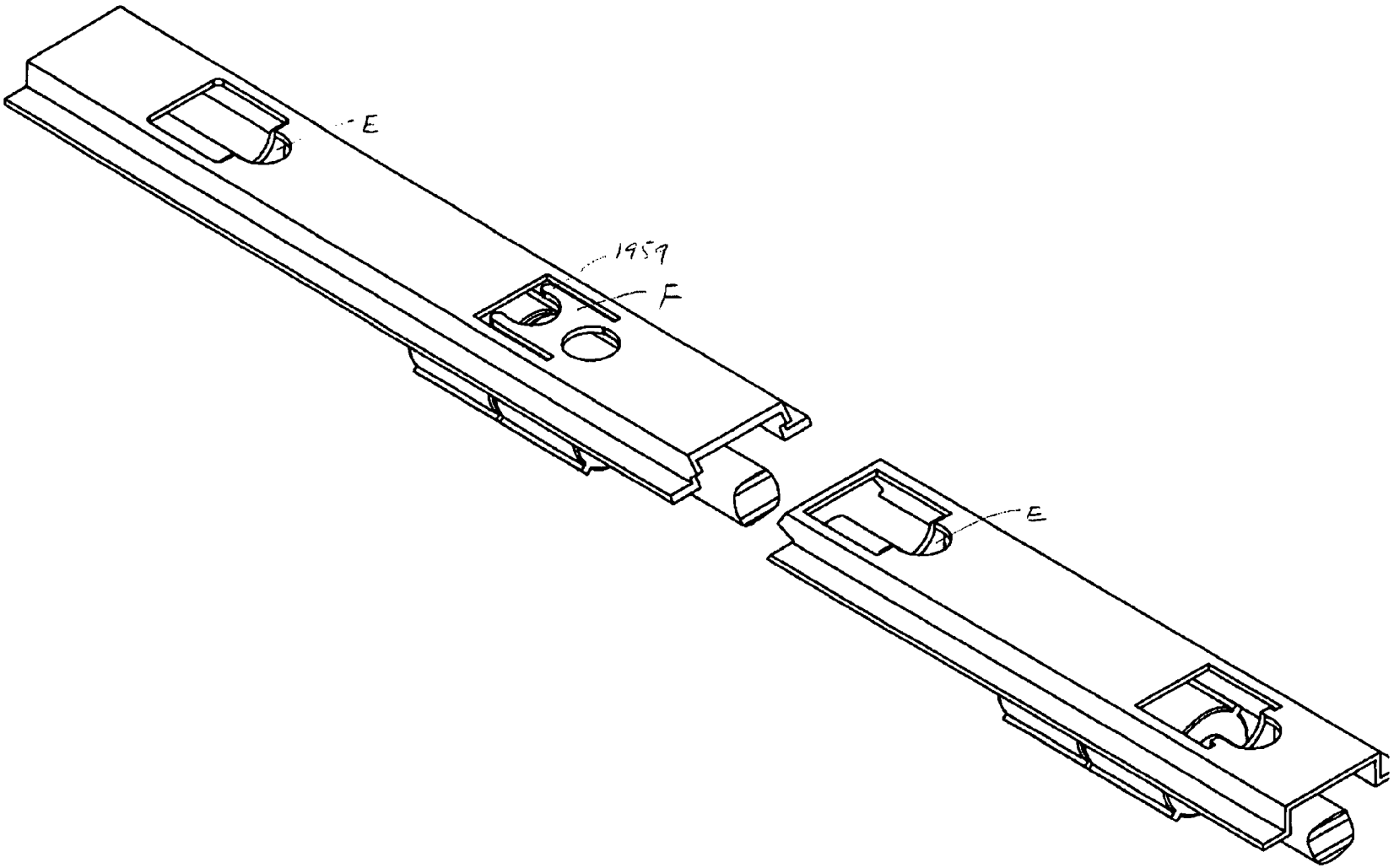
FIG. 32B is an isometric view of the base and light assembly showing a mounting portion thereof.
Figure 33:
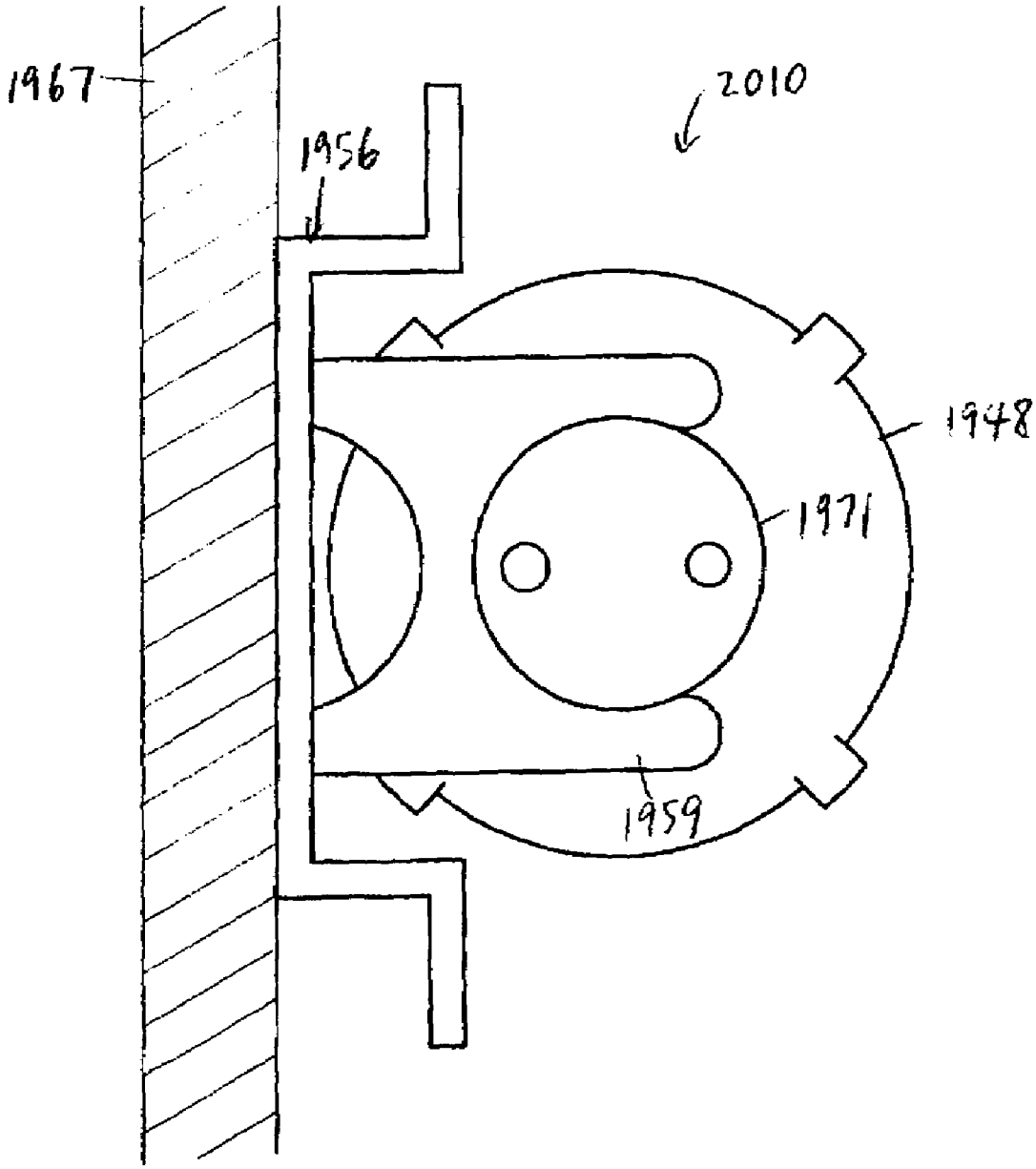
FIG. 33 is a side view of the base of FIG. 31 with the light assembly positioned thereon, drawn at a larger scale.
Figure 34:
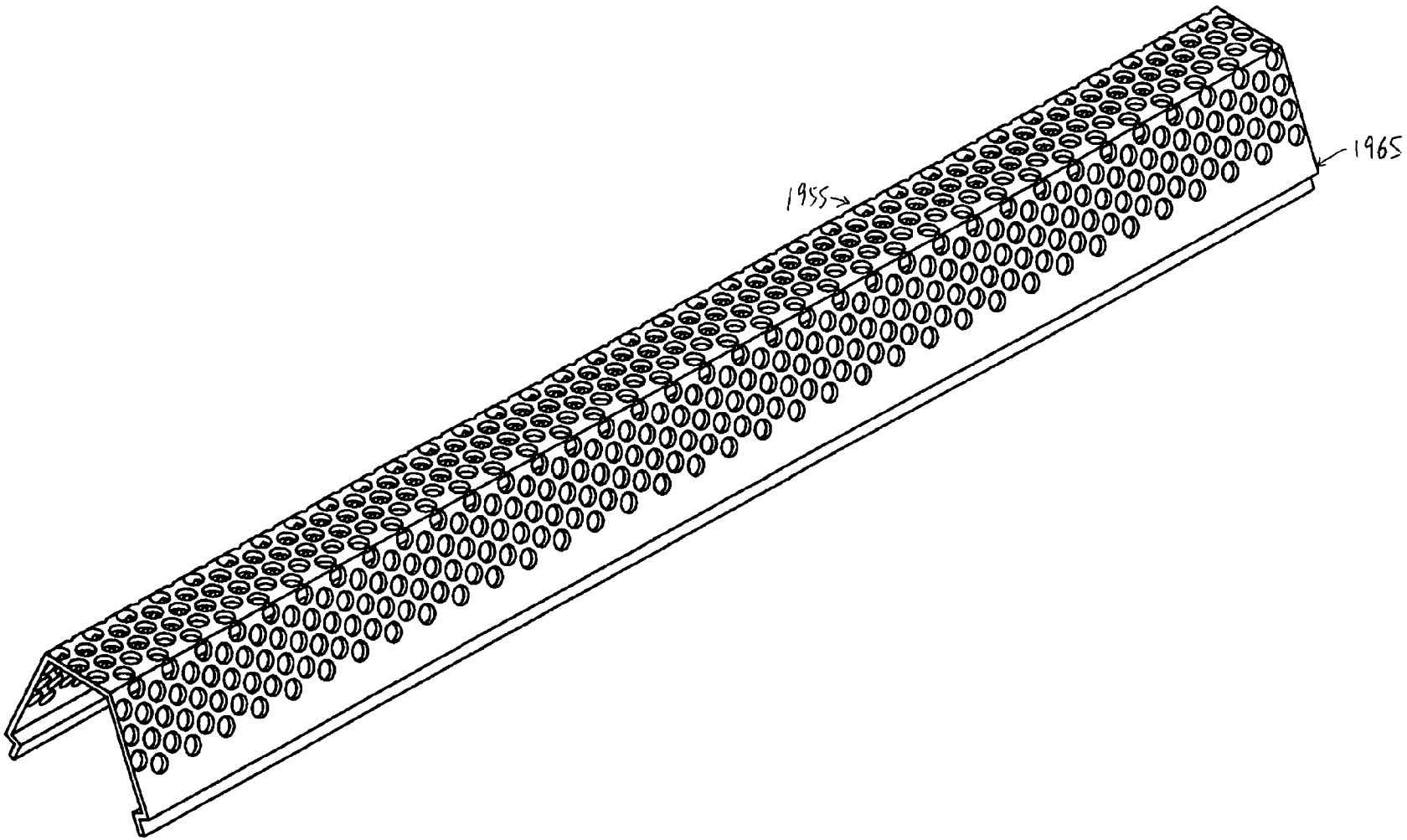
FIG. 34 is an isometric view of the housing on the system of FIG. 28, drawn at a smaller scale.
Figure 35:
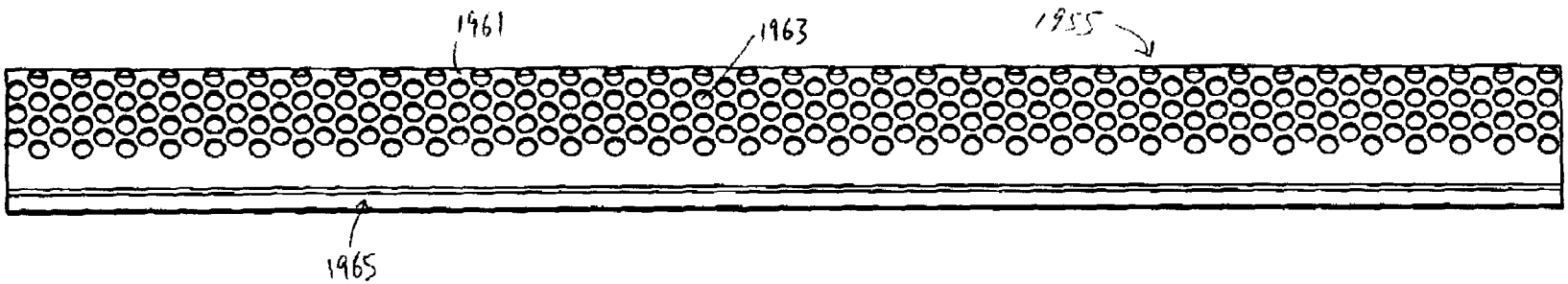
FIG. 35 is a bottom view of the housing of FIG. 34.
Figure 36:
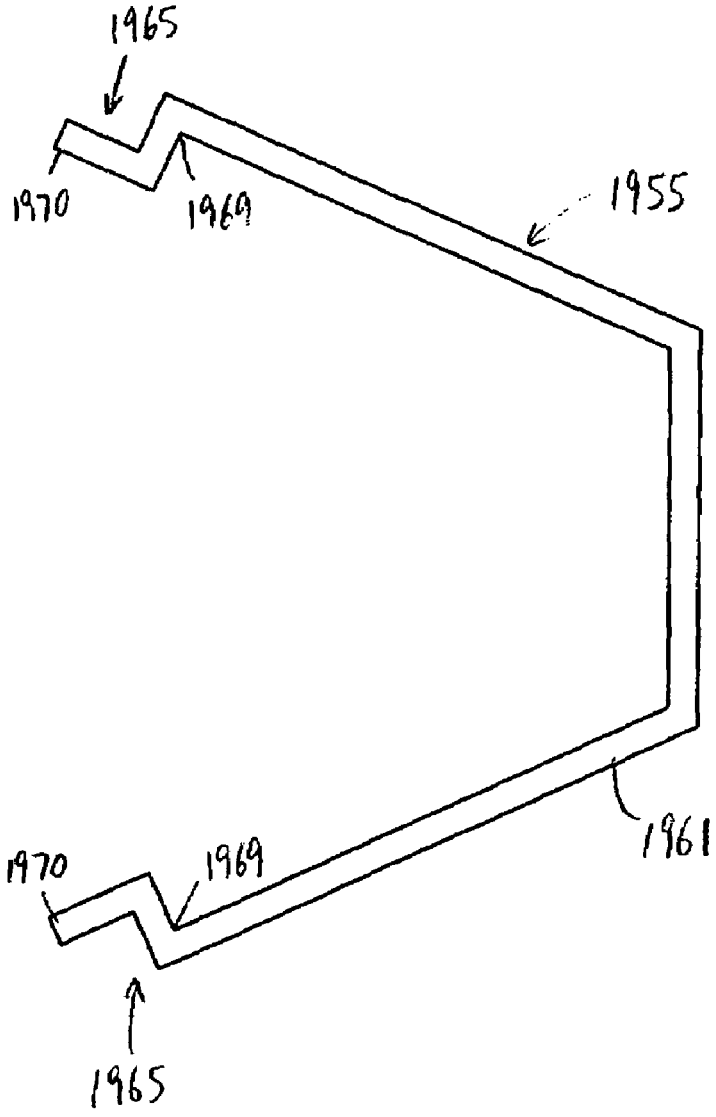
FIG. 36 is a side view of the housing of FIG. 34, drawn at a larger scale.

The base 1956 is formed with the support elements 1959 in operational position (i.e., the elements identified as "E" in FIG. 32A). However, where connectors 1948, 1949 are positioned at a support element, the support element is moved to a flattened position (element "F" in FIG. 32B) to accommodate the connectors.

Subsequently, the housing assembly 1951 is attached to the base 1956. Preferably, the mounting portion 1965 of the body 1955 fits over flanges 1967 which extend along both sides of the base 1956. Preferably, the mounting portion 1965 includes recesses 1969 into which the flanges 1967 on each side of the base 1956 can be received respectively. Preferably, the body 1955 is configured so that the mounting portion 1965 grips the flanges 1967 (i.e., the mounting portion exerts pressure inwardly, in the direction of arrows "M" in FIG. 30) when the flanges 1967 are received in the recesses 1969. From the foregoing, it will be seen that the body 1955 is relatively easily removable from the base 1956. In order to remove the body 1955, ends 1970 are spread apart sufficiently to enable the body 1955 to be pulled away from the flanges 1967.

The base 1956 and the light assembly 1947 can be used together, i.e., without the housing assembly, to provide a light assembly system 2010. The light assembly system 2010 (FIGS. 31-33) includes the base 1956 (adapted to be secured to a structure 1967) and including a plurality of support elements 1959. The light assembly system 2010 also includes the light assembly 1947. The light assembly system 2010 may be used where, for aesthetic reasons, it is preferred.

Figure 37:
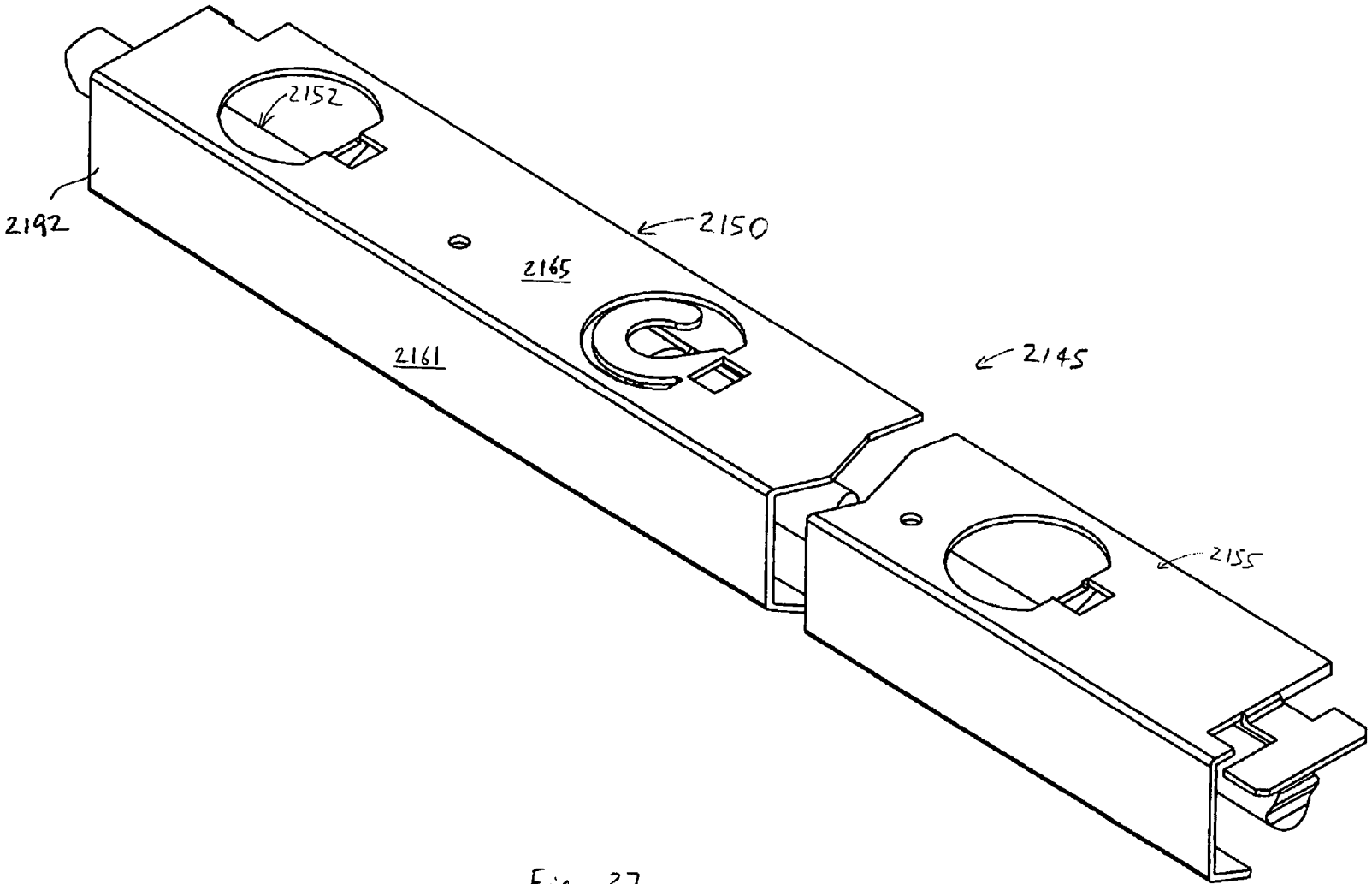
FIG. 37 is an isometric view of another alternative embodiment of a housing and light assembly system of the invention including a housing and a light assembly, drawn at a smaller scale.
Figure 38:
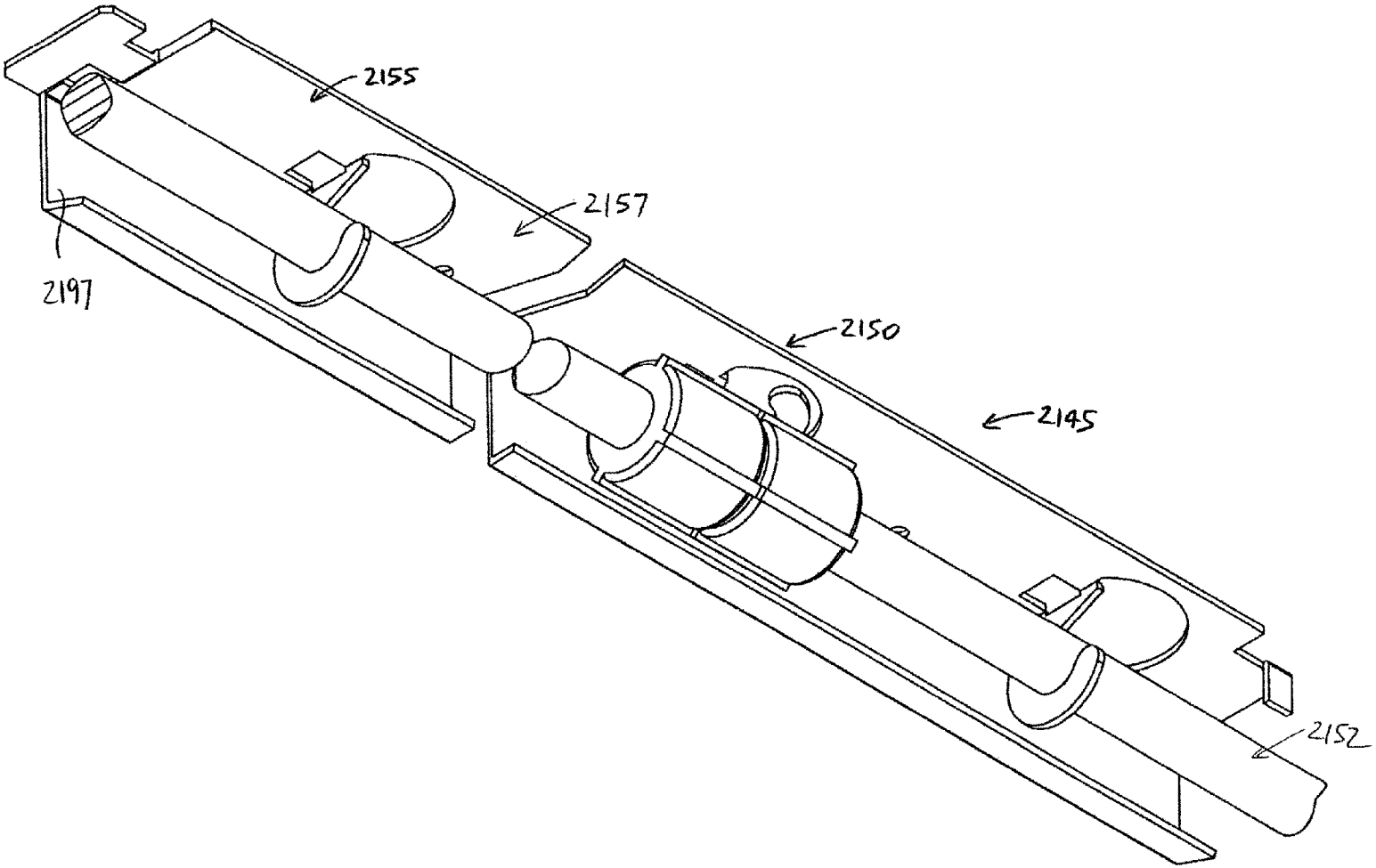
FIG. 38 is an isometric view of a body of the housing of FIG. 37 showing a channel defined by the body, and the light assembly positioned therein.

Another alternative embodiment of a housing and light assembly system 2145 is shown in FIGS. 37 and 38. The housing and light assembly system 2145 includes a housing 2150 in which one or more light sources 2152 are positioned. The housing 2145 includes a body 2155 including a mounting portion 2165 for mounting the housing to a structure and an exposed portion 2161 extending from the mounting portion 2165 at a predetermined angle to define a channel 2157. The housing 2145 also includes one or more support elements 2159 for positioning the light source 2152 in the channel 2157. The exposed portion 2161 obstructs light from the light source 2152, to provide a back lighting effect relative to the exposed portion 2161.

The exposed portion 2161 has an interior side 2197 (FIG. 38) adjacent to the channel 2157 and an exterior side 2192 (FIG. 37) positioned opposite to the interior side 2197. An observer (not shown) observing the exterior side 2192 of the exposed portion 2161 would observe that a back lighting effect is provided by the light source 2152, i.e., a glowing effect is provided which is aesthetically pleasing. In this embodiment, light from the light source 2152 does not travel through the exposed portion 2161. The exposed portion 2161 obstructs light from the light source, resulting in the back lighting effect.

It will be evident to those skilled in the art that the invention can take many forms, and that such forms are within the scope of the invention as claimed. Therefore, the spirit and scope of the appended claims should not be limited to the description of the preferred versions contained herein.

I claim:

1. A housing for holding at least one light source for emitting light observable by an observer, said at least one light source comprising a plurality of segments connected end-to-end the housing comprising: an elongate body defining a channel; at least one support element for positioning said at least one light source in the channel; the body including an exposed portion comprising a plurality of holes through which light from said at least one light source is transmittable; and said at least one support element locating said at least one light source spaced apart from said holes by a preselected distance such that said at least one light source provides a glittering light observable by the observer when the observer is moving relative to the housing; and the exposed portion being open in a direction opposite from the observer such that said at least one light source provides a backlighting effect relative to the exposed portion.

2. A housing according to claim 1 in which:

the body comprises a mounting portion for mounting the housing to a structure;

said at least one support element is integrally formed in the mounting portion; and said at least one support element comprises a receptacle part for receiving a main element of each said segment of said at least one light source in a snap fit.

3. A housing according to claim 2 in which said at least one support element is movable relative to the mounting portion between flattened position, in which said at least one support element is substantially coplanar with the mounting portion, and an operational position, in which said at least one support element extends from the mounting portion into the channel.

4. A housing according to claim 1 in which the body includes a first tab at a first end thereof and a second tab at a second end thereof, the first and second tabs being adapted to mate with respective tabs in other bodies positioned adjacent to the first and second ends respectively, for locating said other bodies substantially in alignment with the body.

5. A housing and light assembly system for emitting light observable by an observer, the system comprising:

a light assembly comprising:

at least one light source comprising a plurality of segments connected end-to-end, each said segment comprising a main element, a first connector, and a second connector, the main element extending between the first connector and the second connector, said connectors being positioned at the ends of each said segment respectively;

a housing assembly comprising:

a plurality of bodies defining at least one channel;

a plurality of support elements for locating said at least one light source in said at least one channel; each said body including an exposed portion comprising through which light from said at least one light source is transmittable; and each said main element being positioned by said support elements in said at least one channel spaced apart from said holes by a preselected distance such that said at least one light source provides a glittering light observable by the observer when the observer is moving relative to the housing assembly; and the exposed portion being open in a direction opposite from the observer such that said at least one light source provides a backlighting effect relative to the exposed portion.

6. A housing and light assembly system according to claim 5 in which:

each said body comprises a mounting portion adapted to be secured to a structure;

each said body has at least one support element integrally formed in each said body respectively; and said at least one support element is movable relative to the mounting portion between a flattened position, in which said at least one support element is substantially coplanar with the mounting portion, and an operational position, in which said at least one support element extends from the mounting portion into said channel.

7. A housing and light assembly system according to claim 5 in which each said support element comprises a receptacle part for receiving said main element in a snap fit.

8. A housing and light assembly system for emitting light observable by an observer, the system comprising:

a light assembly comprising:

at least one light source comprising a plurality of segments connected end-to-end, each said segment comprising a main element, a first connector, and a second connector, the main element extending between the first connector and the second connector, said first and second connectors being positioned at the respective ends of each said segment;

a housing assembly comprising:

at least one base adapted to be secured to a structure; at least one body attachable to said at least one base, said at least one body defining at least one channel; said at least one base comprising a plurality of support elements for locating said at least one light source in said at least one channel when said at least one body is attached to said at least one base; said at least one body including an exposed portion comprising a plurality of holes through which light from said at least one light source is transmittable; and each said main element being positioned by said support elements in said at least one channel spaced apart from said holes by a preselected distance such that said at least one light source provides a glittering light observable by the observer when the observer is moving relative to the housing assembly, and the exposed portion being open in a direction opposite from the observer such that said at least one light source provides a backlighting effect relative to the exposed portion.

9. A housing for holding at least one light source for emitting light observable by an observer, said at least one light source comprising a plurality of segments connected end-to-end, the housing comprising; at least one base adapted to be secured to a structure; at least one body attachable to said at least one base, said at least one body defining at least one channel; said at least one base comprising a plurality of support elements for locating said at least one light source in said at least one channel when said at least one body is attached to said at least one base; said at least one body comprising a plurality of holes through which light from said at least one light source is transmittable; and each said support element locating said at least one light source a preselected distance from said holes such that said at least one light source provides a glittering light observable by the observer when the observer is moving relative to the housing assembly; and the exposed portion being open in a direction opposite from the observer such that said at least one light source provides a backlighting effect relative to the exposed portion.

10. A housing for holding at least one light source for emitting light observable by an observer in a predetermined position relative to a structure, the housing comprising: an elongate body including a mounting portion for mounting the housing to the structure and an exposed portion extending from the mounting portion to define a channel; the exposed portion comprising a plurality of holes through which said light from said at least one light source is transmittable; at least one support element for positioning said at least one light source in the channel spaced apart from said holes by a preselected distance such that said at least one light source provides a glittering light observable by the observer is moving relative to the housing assembly; and the exposed portion being open in a direction opposite from the observer such that said at least one light source provides a backlighting effect relative to the exposed portion.

* * * * *